US005365252A

United States Patent [19]

Lo

[11] Patent Number: 5,365,252

[45] Date of Patent: Nov. 15, 1994

[54] COLOR QUANTIZATION APPARATUS AND METHOD FOR FRAME BUFFER DISPLAY

[75] Inventor: Dick W. Lo, Santa Clara County, Calif.

[73] Assignees: Ricoh Company, Ltd., Tokyo, Japan; Ricoh Corporation, San Jose, Calif.

[21] Appl. No.: 763,809

[22] Filed: Sep. 23, 1991

[51] Int. Cl.[5] ..... G09G 1/28

[52] U.S. Cl. ..... 345/153; 345/186; 345/150

[58] Field of Search ..... 340/701, 702, 703, 798, 340/799; 358/76, 80, 81, 501, 518, 519, 520, 523, 524; 395/131; 345/150, 153, 155, 185, 186; 348/649, 655

[56] References Cited

U.S. PATENT DOCUMENTS 4,901,258 2/1990 Akiyama ..... 358/80
5,049,986 9/1991 Aomo et al. ..... 340/703
5,087,965 12/1992 Torre-Bueno ..... 358/80

*Primary Examiner*—Ulysses Weldon
*Assistant Examiner*—Doon Yue Chow
*Attorney, Agent, or Firm*—Flehr, Hohbach, Test, Albritton & Herbert

[57] ABSTRACT

A digital color image display system adapted to a frame buffer for displaying color images. The system includes apparatus for color quantization. The color distribution of a color image is stored in a memory device (HIST-TABLE). The memory device has address format of r0g0b0r1g1b1. . . rnbnzn, where ri is ith bit in red color bits, gi is ith bit in green color bits, and bi is ith bit in blue color bits. Thus, each pixel can be mapped into one of the addresses of the memory device according to its three basic color bits (red, green and blue); and the three basic color bits form a color universe cell in a 3-dimensional space. To select 256 colors from a color image, the color universe cell is divided into 256 color cells according to the color distribution. Because the special address arrangement of the memory device, the division of the color universe cell can be easily accomplished by flipping one bit of the index to the memory device, thus increasing the speed to select 256 colors and reducing complexity of the hardware.

21 Claims, 22 Drawing Sheets

| | | HEAD | TAIL | WEIGHT |
|---|---|---|---|---|
| | | r0g0b0r1g1b1r2g2b2r3g3b3 | r0g0b0r1g1b1r2g2b2r3g3b3 | |
| INITIAL STATE | | 0 0 0 0 0 0 0 0 0 0 0 0 | 1 1 1 1 1 1 1 1 1 1 1 1 | $W_U$ = THE NUMBER OF TOTAL PIXELS |
| STEP 1 | A : | 0 0 0 0 0 0 0 0 0 0 0 0 | 0* 1 1 1 1 1 1 1 1 1 1 1 | $W_A$ |
| | B : | 1* 0 0 0 0 0 0 0 0 0 0 0 | 1 1 1 1 1 1 1 1 1 1 1 1 | $W_B$ |
| STEP 2 | A : | 0 0 0 0 0 0 0 0 0 0 0 0 | 0 1 1 1 1 1 1 1 1 1 1 1 | $W_A$ |
| | D : | 1 0 0 0 0 0 0 0 0 0 0 0 | 1 0* 1 1 1 1 1 1 1 1 1 1 | $W_D$ |
| | C : | 1 1* 0 0 0 0 0 0 0 0 0 0 | 1 1 1 1 1 1 1 1 1 1 1 1 | $W_C$ |
| STEP 3 | A : | 0 0 0 0 0 0 0 0 0 0 0 0 | 0 1 1 1 1 1 1 1 1 1 1 1 | $W_A$ |
| | F : | 1 0 0 0 0 0 0 0 0 0 0 0 | 1 0 0* 1 1 1 1 1 1 1 1 1 | $W_F$ |
| | E : | 1 0 1* 0 0 0 0 0 0 0 0 0 | 1 0 1 1 1 1 1 1 1 1 1 1 | $W_E$ |
| | C : | 1 1 0 0 0 0 0 0 0 0 0 0 | 1 1 1 1 1 1 1 1 1 1 1 1 | $W_C$ |
| STEP 4 | H : | 0 0 0 0 0 0 0 0 0 0 0 0 | 0 0* 1 1 1 1 1 1 1 1 1 1 | $W_H$ |
| | G : | 0 1* 0 0 0 0 0 0 0 0 0 0 | 0 1 1 1 1 1 1 1 1 1 1 1 | $W_G$ |
| | F : | 1 0 0 0 0 0 0 0 0 0 0 0 | 1 0 0 1 1 1 1 1 1 1 1 1 | $W_F$ |
| | E : | 1 0 1 0 0 0 0 0 0 0 0 0 | 1 0 1 1 1 1 1 1 1 1 1 1 | $W_E$ |
| | C : | 1 1 0 0 0 0 0 0 0 0 0 0 | 1 1 1 1 1 1 1 1 1 1 1 1 | $W_C$ |
| | : | | | : |
| | : | | | : |
| STEP 255 | | : | | |

FIG.—18

COLOR QUANTIZATION APPARATUS AND METHOD FOR FRAME BUFFER DISPLAY

BACKGROUND OF THE INVENTION

1. Field of the Invention

This invention relates generally to color image display systems, and more particularly to digital color image display systems used with a frame buffer.

2. Description of the Prior Art

Traditionally, digital color images are composed a large number of array of individual pixels. Each pixel in the color image associates with position information indicating its position in the array, and color information including three basic colors (red, green and blue) so that the composite of the three basic colors attains the desired color for the pixel. Typically, each basic color in a pixel is 8 bits (1 byte) long, and each pixel in the color image has 24 bits. The color information for all pixels is stored in a digital memory device.

Referring to FIG. 1, there is shown a typical digital color display system 10 which includes a color image transducer 12 (video camera, scanner or facsimile), an image processor 14, a memory device 16, a frame buffer 18 and a displayer 24. The image processor is responsible for controlling the color image transducer, the memory storage, the frame buffer and the displayer, and to process the imaging information. In the process of color imaging, color image transducer 12 converts desired color images into pixels arranged in an array format. Typically, the color image transducer generates approximately 8 mega pixels for a $8.5\times11$ color image at 300 dots per inch (dpi) density. The color information for the pixels are then stored into memory device 16. Because each pixel has three basic colors with each color having 8 bits, approximately 24 mega bytes memory size is needed to store the color information for all pixels. Image processor 14 processes the color information stored in memory device 16 and feeds the processed color information into frame buffer 18. The frame buffer includes a color table 20 and an index memory 22. The color table stores the color combinations for the color image, and the index memory stores the color table and the position information for each pixel. Finally, each of the pixels is displayed at a specific position on displayer 24 according to the color information stored in color table 20 for a color image.

Theoretically, in a color image, each pixel has 16 ($2^{24}$) million possible combinations of full colors; in other words, the 16 million possible combinations of full colors form a color space, and the color of any individual pixel in the color image is distributed within the color space. Thus, for a specific image, the color of all pixels in the color image has a specific distribution pattern in the color space. However, in practice, fewer colors are selected to display the color image to considerations such as cost, memory size restriction and speed. In typical frame buffers available in the present market, the color table has a memory with a size of 256 cells for storing selected colors. Thus, in order to use a typical frame buffer to display a full color image, it is necessary to select 256 colors from the color image and map the 16 million possible combinations of full colors into the 256 colors for all pixels stored in memory storage 10. Such selecting and mapping process are called color quantization.

There are several algorithms to select the 256 colors from the color image to be displayed. Generally speaking, the desired criteria of the color selection method are: 1) preserving originality of the color image; 2) having high speed; 3) being easy to be implemented on hardware; and 4) being adaptable to expansion.

One of the algorithms uses a predefined color table which statistically is the most popular colors to represent a color image. The disadvantage of this algorithm is that the color table does not depend on the color distribution of the image itself. For example, if the color image has a lot of red elements, the predefined color table cannot be able to reflect more redness in the color table.

Another algorithm called Medium Cut algorithm subdivides color space for a color image into smaller and smaller rectangular boxes. The division algorithm is based on cutting the boxes along the medium point so that equal number of pixels falls on each side. As a result, each box contains the same number of pixels. One of the disadvantages of this algorithm is that it takes time to calculate the medium point in each division, thus reducing the speed.

Another algorithm divides the color space for a color image into 64 uniform cells. It then calculates an axis with the highest variance in each of the 64 cells. The 32 cells with the largest variance are divided into 2 along the axis with the largest variance. Variance, a mathematical term, is used to measure the degree of changes in a set of samples. So a cell with larger variance means that there is a more uneven distribution of colors in the cell. By dividing cells with the largest variance, the color image can be more accurately represented. This process is repeated 6 times to generate 256 cells in the color space. The disadvantage of this algorithm is the first 64 cells are created independent of the color distribution of the image. Moreover, calculating the variance is even more time-consuming than calculating the medium value. Furthermore, more complicated algorithm may involve higher hardware cost.

Thus, there is a need for a fast color quantization algorithm which has the features of easy hardware implementation, adaptability to expand and preserve originality of the color image.

SUMMARY OF THE INVENTION

In one respect, the invention provides a digital color image display system which includes a color image transducer for converting a color image into an array of pixels and a storage device for storing color information associated with each of the pixels. The color information is composed of three basic colors, each of which has n bits. Thus all color combinations of three n bits of the three basic colors form a color universe which includes all the pixels. The digital color image display system further includes a first memory means for storing pixel distribution of the color image in the color universe, and a first address means for mapping the pixels into addresses of the first memory means. Since the first memory means has a sequence addresses which cover the whole boundary of the color universe, the first address means can map each of the pixels into one of said addresses of the first memory means according to the three n bits of the three basic colors associated with the pixel.

The three n bits of said three basic colors have the format r0 r1 r2 r3 . . . rn g0 g1 g2 g3 . . . gn b0 b1 b2 b3 . . . bn

The sequence addresses of the first memory means have a special format of r0 g0 b0 r1 g1 b1 r2 g2 b2 . . . rn gn bn, and the first address means generates address by converting said three n bits of said three basic colors into a format of r0 g0 b0 r1 g1 b1 r2 g2 b2 . . . rn gn bn.

In another aspect, the invention provides a new method for processing color quantization. The method includes the steps of storing pixel distribution of the color image in the color universe to the first memory means having a sequence address in a format of r0 g0 b0 r1 g1 b1 r2 g2 b2 . . . rn gn bn, and mapping each of the pixels into one of the addresses of the first memory means according to the three n bits of the three basic colors associated with the pixel.

Thus, by arranging the three n color bits in a special bit order as the addresses of the first memory means, and by converting the color information in each pixel arrangement into a special order and mapping the color information into the first memory address, the color quantization becomes simple and fast. The division of the color universe can be accomplished by flipping one bit of the index to the first memory means; the weight of a split color cell can be obtained by summing a section of the first memory means according to the index. The simple nature of the invention allows hardware implementation to further speed up the process; and the symmetric nature of the invention makes it feasible to be expanded, Since weights for each split color cell are considered during dividing the color universe cell, the colors are accurately selected.

BRIEF DESCRIPTION OF THE DRAWINGS

The purpose and advantages of the invention will be apparent to those skilled in the art from the following detailed description in conjunction with the appended drawings in which:

FIG. 18 illustrates the changes of heads and tails in the FABLE during the division process.

DETAILED DESCRIPTION OF THE PREFERRED EMBODIMENT

This invention provides an efficient and simple algorithm to select the 256 colors from a color image and map all pixels in the color image into the 256 colors. First, the general principle of the algorithm to select 256 colors is described as follows:

1. Algorithm Description

Figure 1:
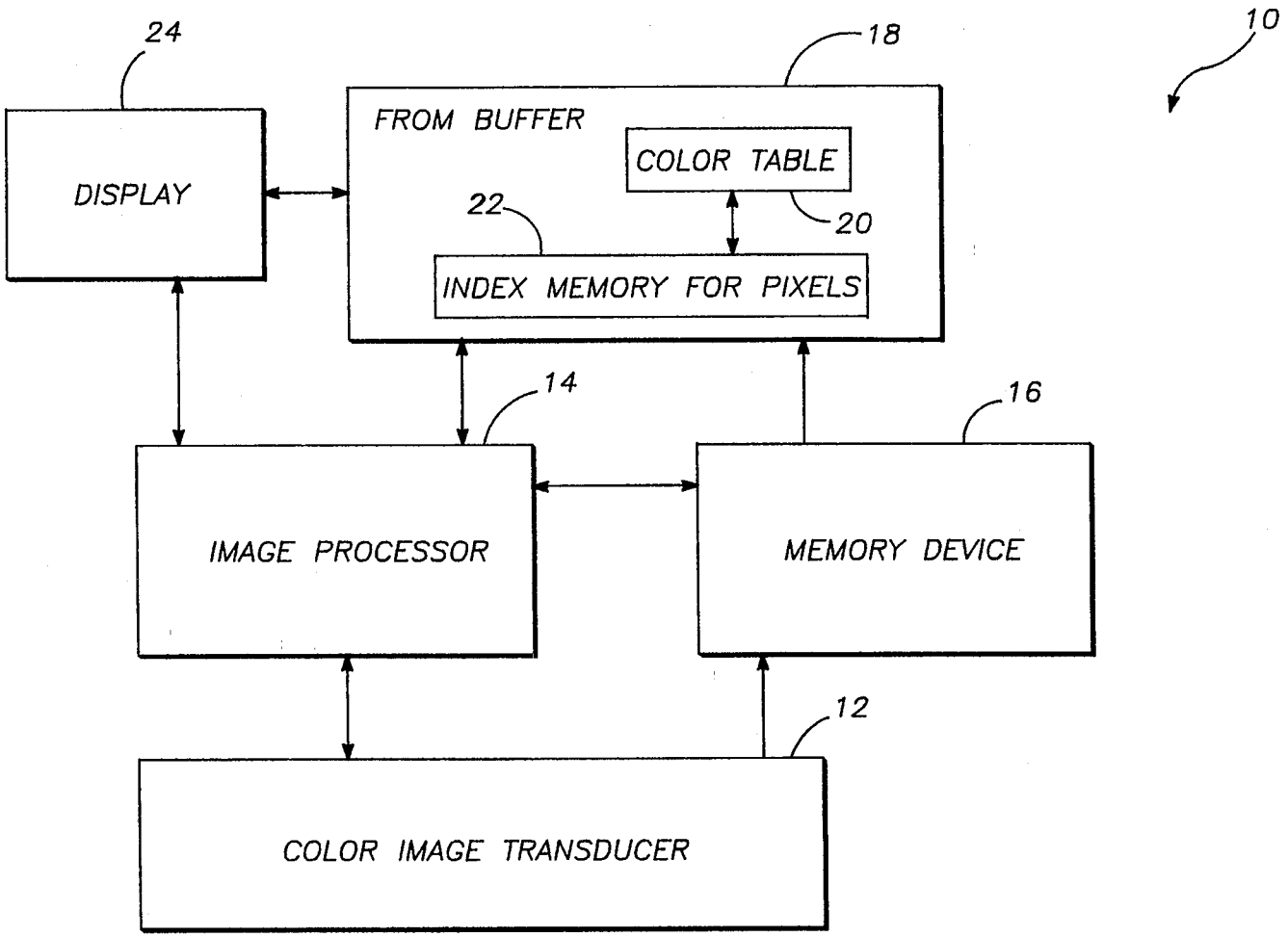
FIG. — 1 (PRIOR ART)
FIG. 1 illustrates the block diagram of a typical digital color display system (prior art).
Figure 2:
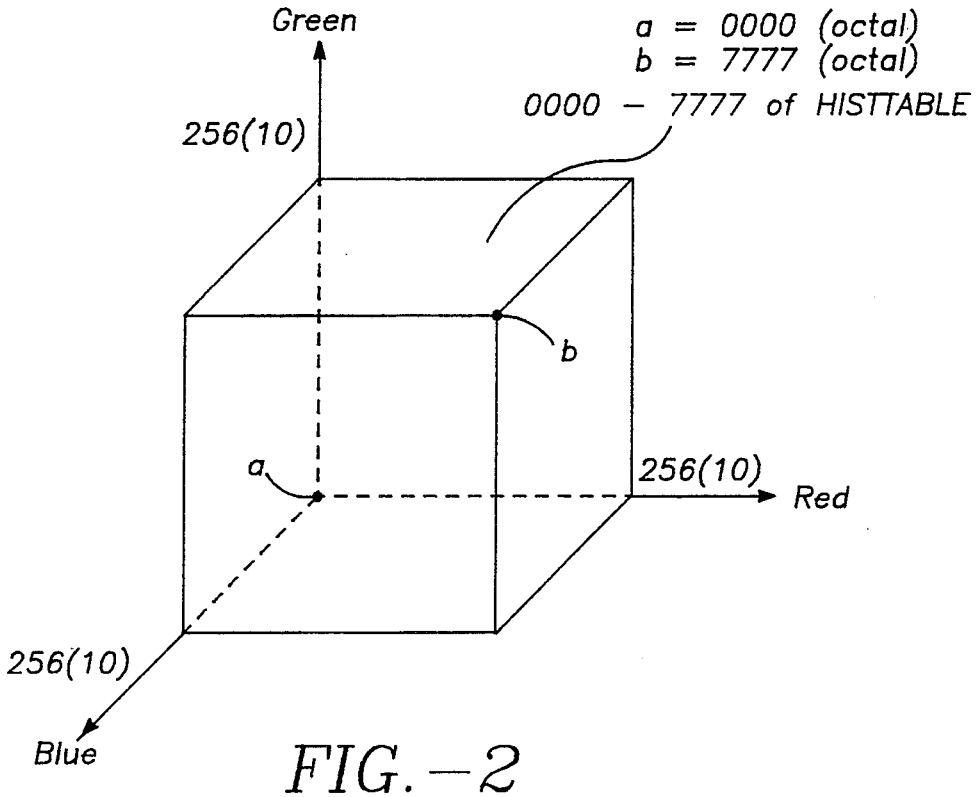
FIG. 2 illustrates a color universe cell.

If red, green and blue components of the color image are considered as three orthogonal components in a 3-dimensional (3-D) space, a color universe can be defined as a cell (color universe cell) in the 3-D space. Referring to the illustrative drawings of FIG. 2, there is shown a color universe cell having a size of 256×256×256. The color universe cell contains all the possible 16 million combinations of full colors. Because each of the three basic colors (red, green or blue) typically has 8 bits, the color bits for a pixel has the format as follows:

| | | | | | | | | |
|---|---|---|---|---|---|---|---|---|
| red | r0, | r1, | r2, | r3, | r4, | r5, | r6, | r7 |
| green | g0, | g1, | g2, | g3, | g4, | g5, | g6, | g7 |
| blue | b0, | b1, | b2, | b3, | b4, | b5, | b6, | b7 |

Therefore, a specific combination of the 24 color bits relating to an individual pixel defines a color vector within the boundary of the color universe cell. Thus, color vectors for all pixels in a color image are enclosed within the boundary of the color universe cell. More specifically, for a color image of 8.5×11 at 300 dpi density, approximately 8 mega color vectors are enclosed within the color universe cell.

Figure 3:
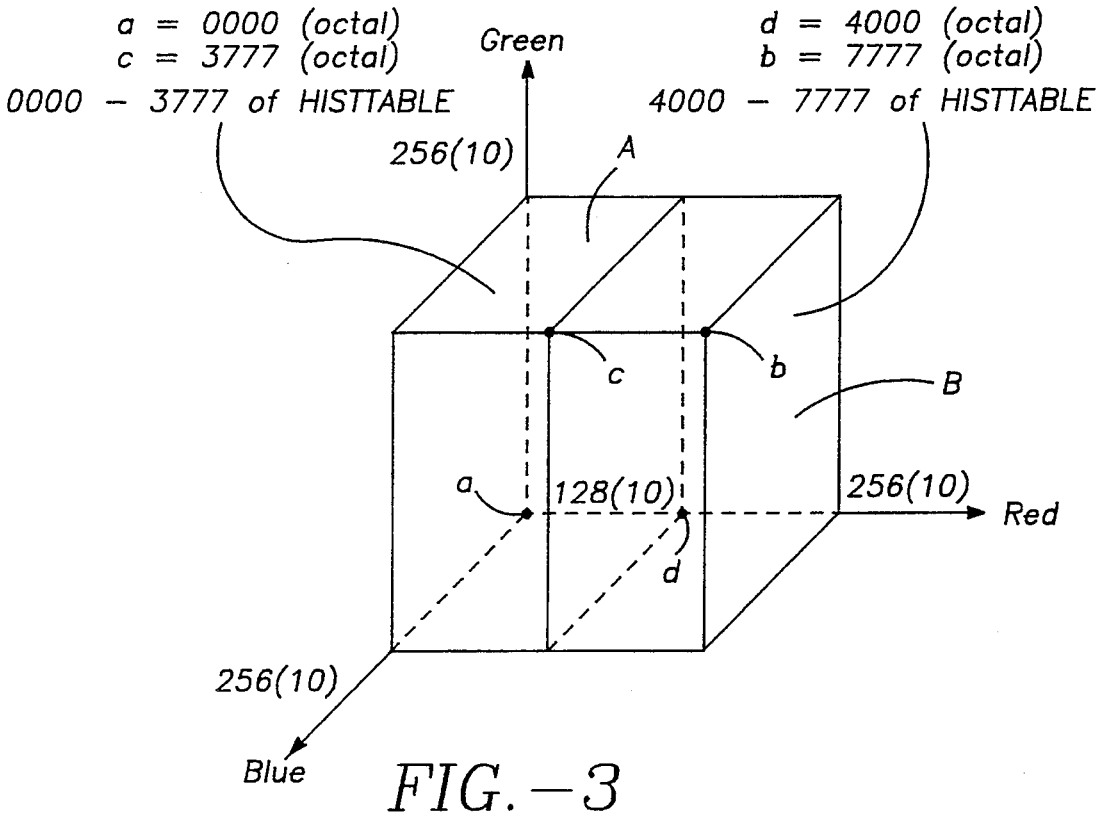
FIG. 3 illustrates the color universe cell that is divided into two color cells.

Referring to FIG. 3, there is shown that the color universe cell is cut into two equal parts, namely cell A and cell B, along one of the three axes (Red axis). The number of pixels within a cell is defined as the weight of that cell. The weight of an undivided color universe cell is the total number of pixels in a color image. In order to decide which cell should be further divided, the weights of cell A and B are computed. The cell with the larger number of pixels (heavier weight) is further cut into two parts along the longest (or longer) axis.

Figure 4:
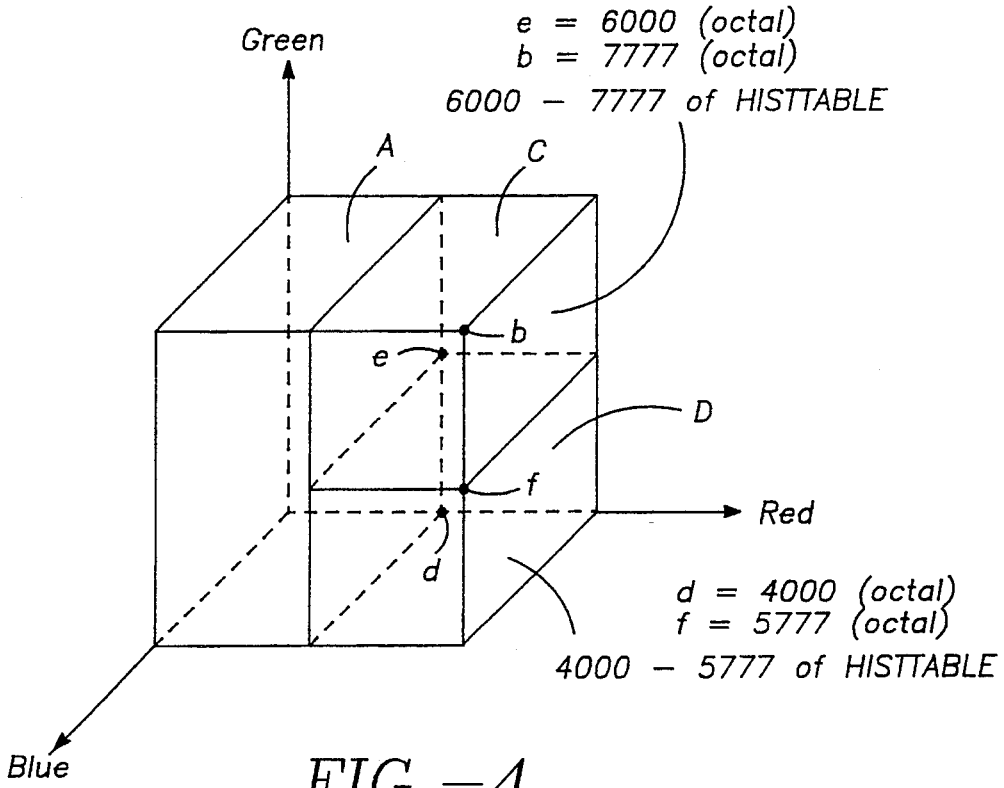
FIG. 4 illustrates the color universe cell that is divided into three color cells.

Referring to FIG. 4, there is shown that the cell B is cut into two equal parts, namely cell C and cell D, along the longer side of one of the three axes (Green axis), assuming that cell B contains the largest number of pixels (or has heaviest weight) and is chosen to be divided. The weights of the three cells (A, C, D) are computed to decide which cell should be divided next.

Figure 5:
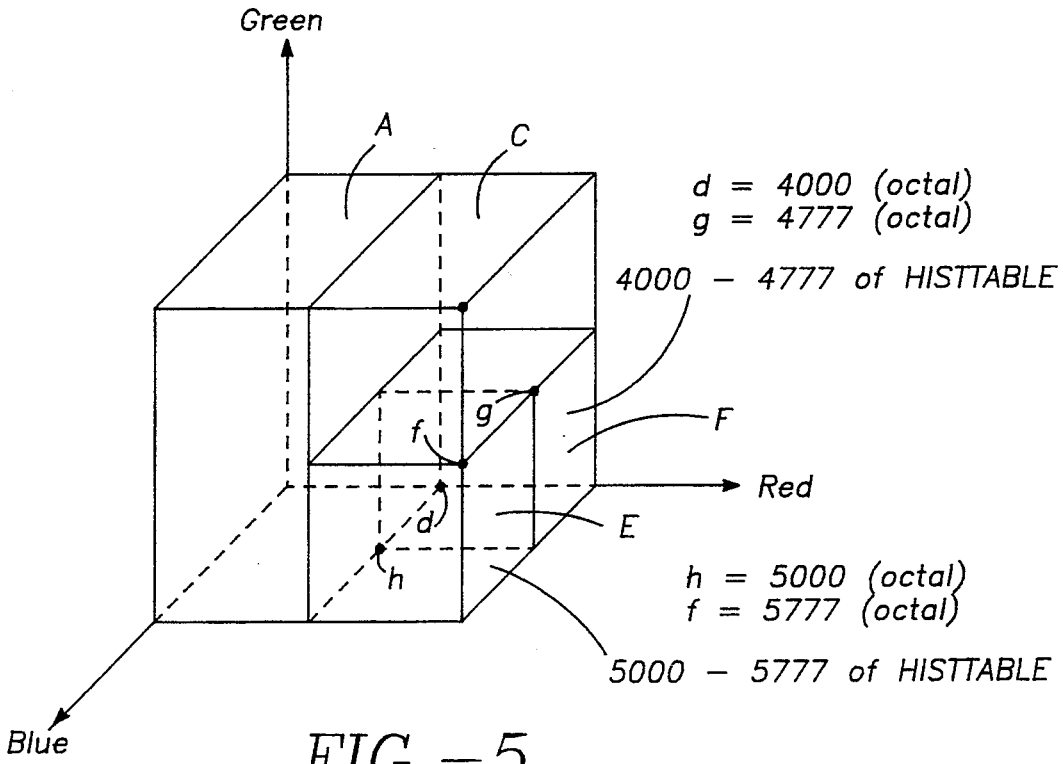
FIG. 5 illustrates the color universe cell that is divided into four color cells.

Referring to FIG. 5, there is shown that cell D is cut into two equal parts, namely cell E and cell F, along the longer side axis (Blue axis), assuming cell D has the heaviest weight, and is chosen to be divided.

Figure 6:
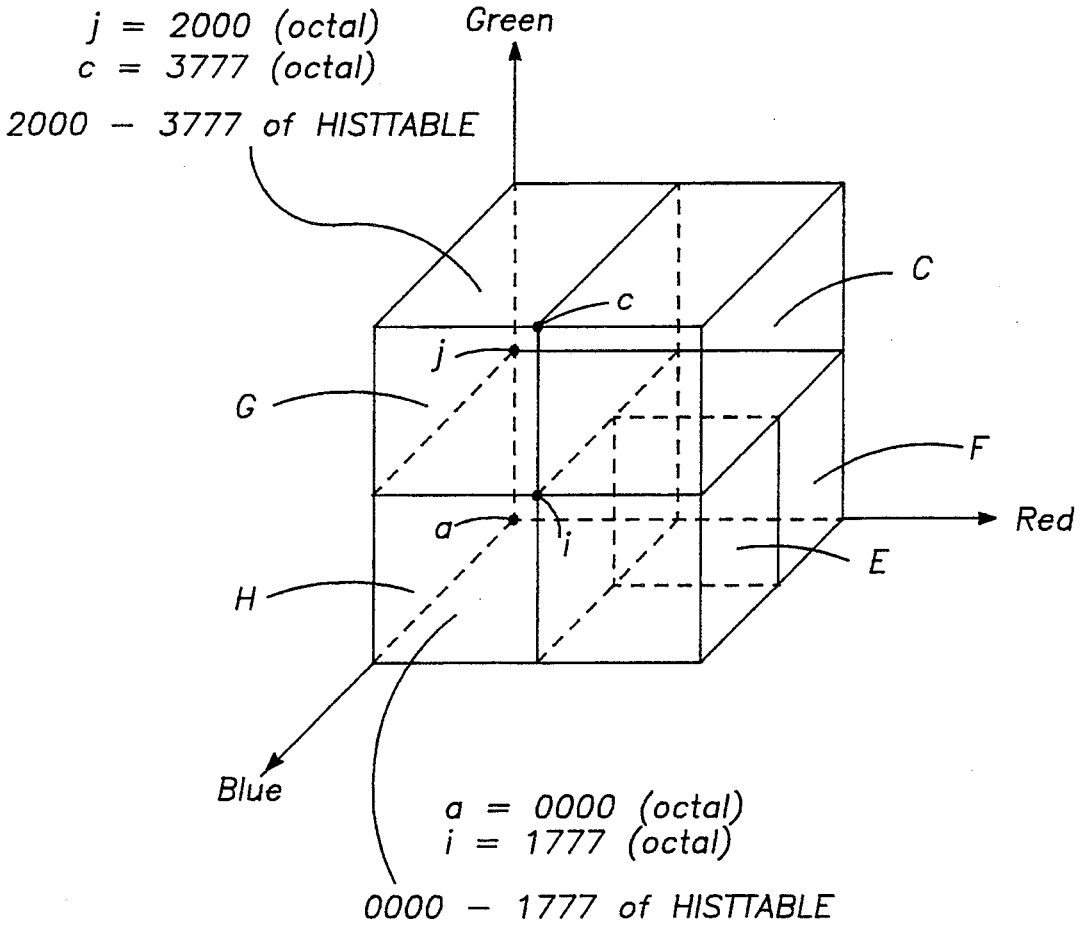
FIG. 6 illustrates the color universe cell that is divided into five color cells.

Referring to FIG. 6, there is shown that the cell A is cut into two equal parts, namely, cell G and cell H, along the longer side axis (Green), assuming that cell A has the heaviest weight and is chosen to be divided. The above division scheme will continue until 256 cells are created. If the cell which has the heaviest weight is of unit size ($1\times1\times1$ if all 24 color bits are used), the next heaviest cell which is larger than 1 cubic size is chosen to be divided instead.

After the color universe cell is divided into 256 cells, the centroid of each cell is used to represent the color for all pixels within that cell, meaning all the pixels inside the cell are assigned to the color represented by the centroid. As a result, 256 colors are chosen for 16 million possible combinations of full colors, and each of the pixels in the color image are mapped to one of the 256 colors.

However, color vectors with three elements are difficult to be arranged in a sequence. The present invention provides a special color bit data structure which makes the division of the color universe cell simple and fast. The present invention also provides an efficient and simple method to create an index to the 256 selected colors for all pixels in the color image.

2. Implentation of the Invention

Figure 7:
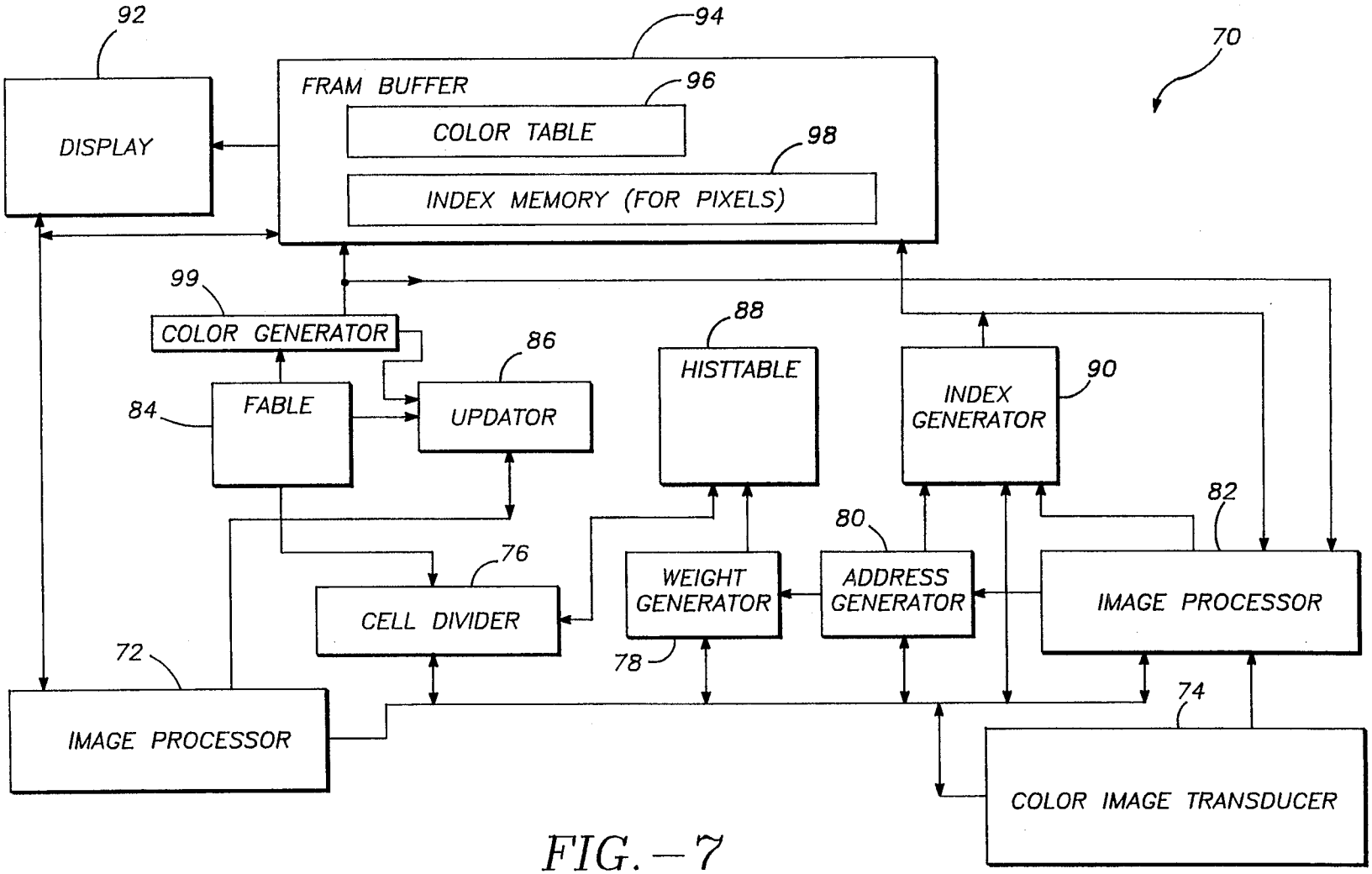
FIG. 7 illustrates the block diagram of the digital color image display system in accordance with the invention.

Referring to FIG. 7, there is shown a digital color image display system 70 in accordance with the present invention. Image processor 72 controls all execution units of digital color image display system 70 during the color image display process. Color image transducer 74 converts a color image to be displayed into a number of pixels. Storage device is responsible to store the color and position information for all the pixels. Cell divider 76, weight generator 78, address generator 80, FABLE (memory) 84, updator 86 and HISTTABLE (memory) 88 are, through their cooperation, responsible to select the 256 colors. HISTTABLE 88, address generator 80 and index generator 90 are, through their cooperation, responsible to generate index to the 256 colors for all pixels. Frame buffer 94 stores the 256 colors in color table 96 and indexes color table 96 for all pixels into index memory 98. Displayer 92 displays all pixels according to the position information in index memory 98 and color information in color table 96.

In order to reduce memory size and increase the speed, the embodiment of the present invention selects first 4 color bits for the three basic colors. Thus, the color bits for each pixel are formatted as follows:

| | |
|---|---|
| red | r0, r1, r2, r3 |
| green | g0, g1, g2, g3 |
| blue | b0, b1, b2, b3 |

The r0, r1, r2, r3 are the most significant 4 bits of the red component. The g0–g3 and b0–b3 bits are the most significant 4 bits of green and blue components respectively.

Figure 8:
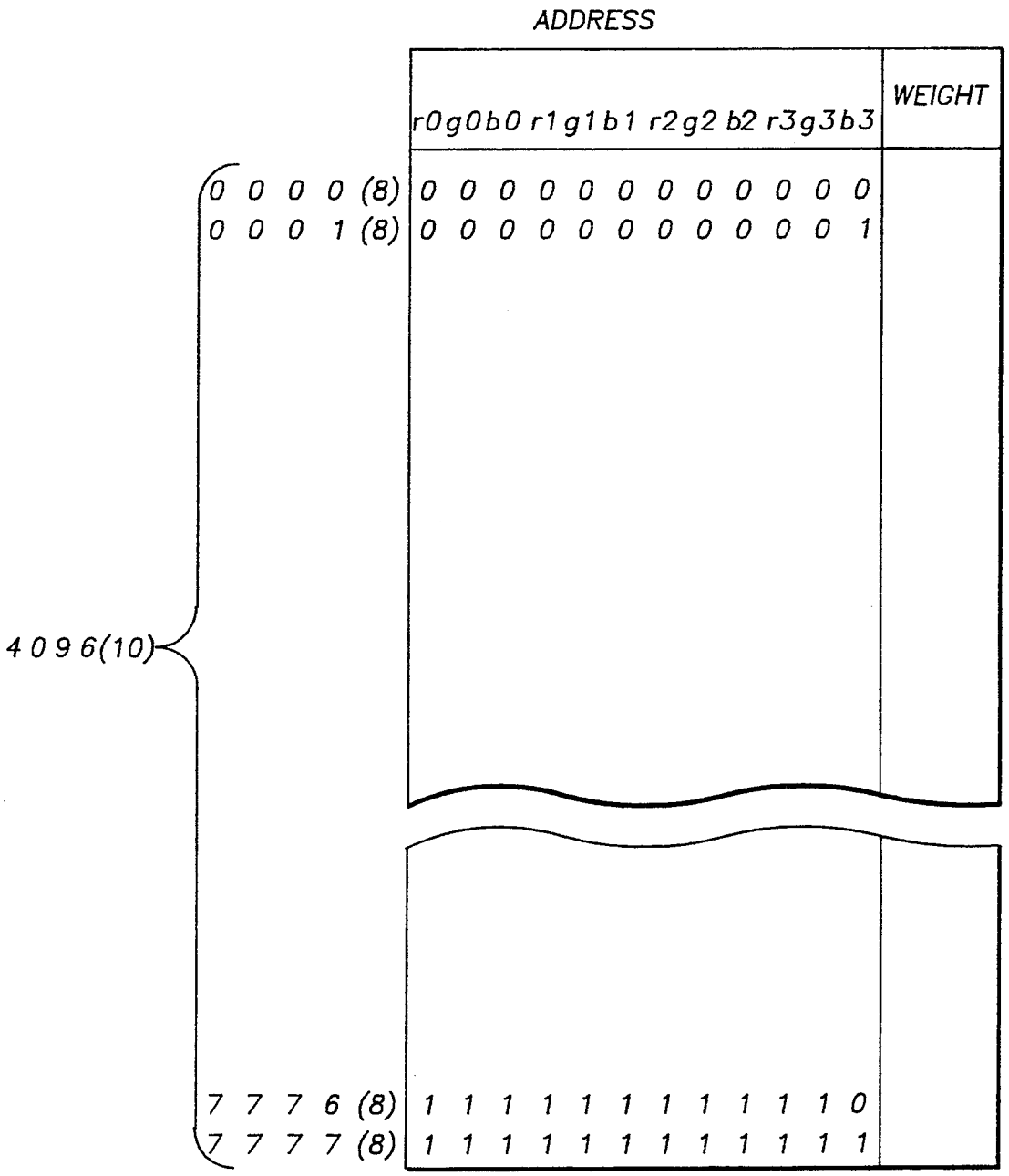
FIG. 8 illustrates the structure of HISTTABLE of FIG. 7.

Referring to FIG. 8, there is shown the detail of HISTTABLE 88 which actually can be a memory. The combinations of 12 color bits shown on the left column of the HISTTABLE identify the memory addresses. By using the 12 color bits to identify memory address, the HISTTABLE has 4096 memory cells ($2^{12}$) with addresses from 0000 to 7777 (in octal). A specific color vector for an individual pixel can be mapped into a specific memory address according to its color information. The "Weight" on right column of the HISTTABLE represents a count of number of pixels corresponding to a specific memory address of the HISTTABLE. Thus, if the color vectors of all pixels in the color universe cell are mapped into the addresses from 0000 (in octal) to 7777 (in octal), the HISTTABLE can be used to indicate color distributions of the color image in the color universe cell.

Figure 9:
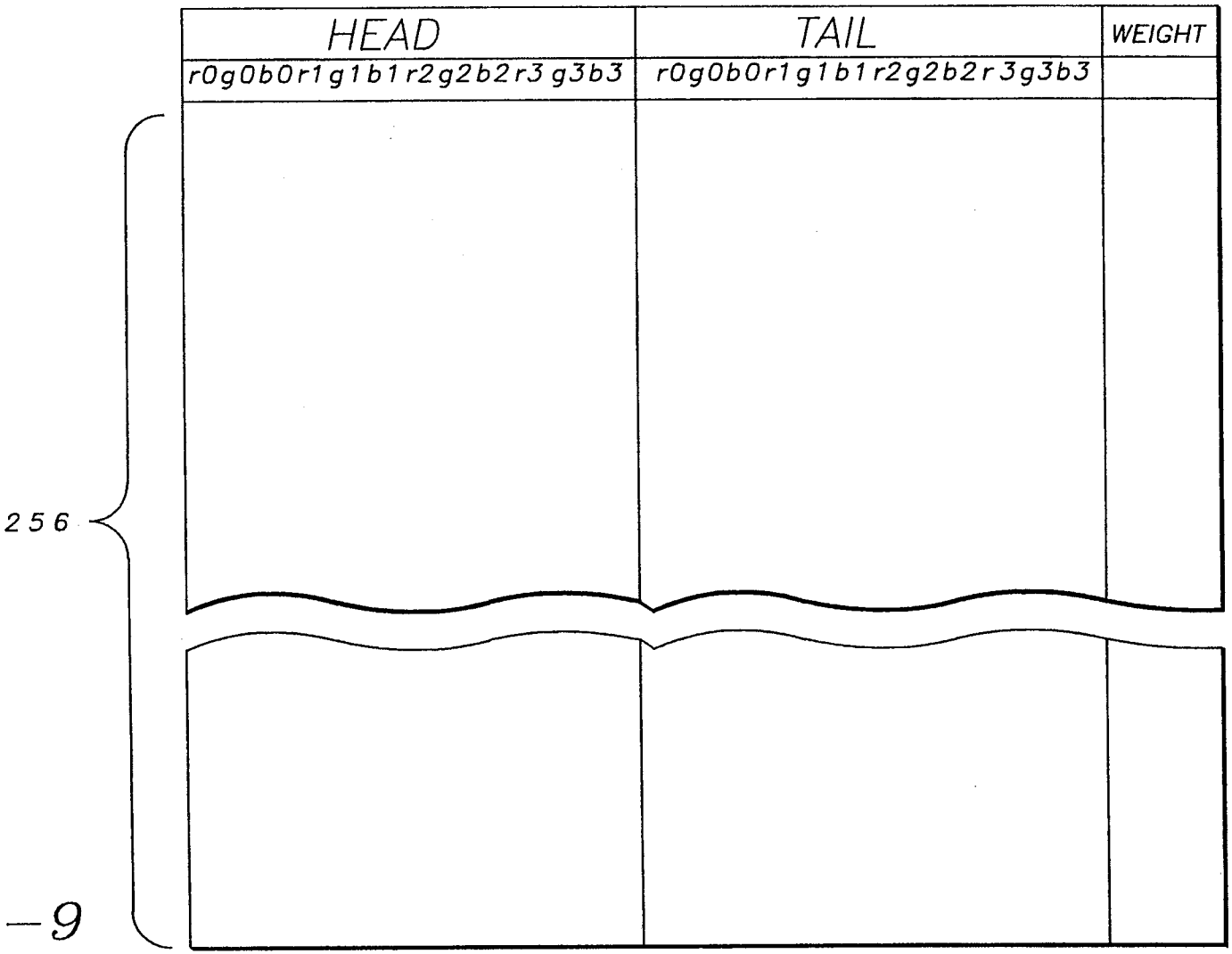
FIG. 9 illustrate the structure of FABLE of FIG. 7.

Referring to FIG. 9, there is shown the detail of FABLE 84 which also actually can be a memory. The "Head" and "Tail" columns indicate an address range of the HISTTABLE. This range actually corresponds to the boundary of a color cell in the color universe cell. The "Weight" column indicates the number of pixels within the boundary of the color cell. The size of the FABLE equals the number of colors to be selected. Since 256 colors are selected in the embodiment, the FABLE has a size of 256. Before the color universe cell is divided, there is only one head (0000 in octal) and one tail (7777 in octal). The range of the head and the tail covers the total HISTTABLE address. The weight of the color universe cell is the number of all pixels in a color image.

During each division of the color universe cell, a new head and a new tail are added into the FABLE to record the boundary of the split color cell. The heads and tails in the FABLE are adjusted to indicate new address ranges corresponding to a divided color universe cell. The new weights are calculated according the new heads and new tails.

It is noticed that the HISTTABLE and the FABLE use a special arrangement of the 24 color bits as follows:

r0 g0 b0 r1 g1 b1 r2 g2 b2 r3 g3 b3

By this special arrangement, a three dimension color vector is converted to a one dimension number which makes it easier to arrange three dimension vectors into one dimension sequences.

To facilitate a further detailed explanation, let us first observe how each color bit affects the division of the color universe cell. Referring to the illustrative drawings of FIG. 10, there is shown that the two possible values ("0" or "1") of r0 bit divides the color universe cell into part R0 and Part R1. If a color vector has "0" value of r0 bit, it will fall within part R0; and if a color vector has "1" value of r0 bit, it will fall within part R1. That is:

| r0g0b0 | r1g1b1 | r2g2b2 | ... | r7g7b7 | |
|---|---|---|---|---|---|
| 0 x x | x x x | x x x | ... | x x x | (part R0 of FIG. 10) |
| 1 x x | x x x | x x x | ... | x x x | (part R1 of FIG. 10) |

The symbol "x" means the respective bit can be either "0" or "1".

Figure 11:
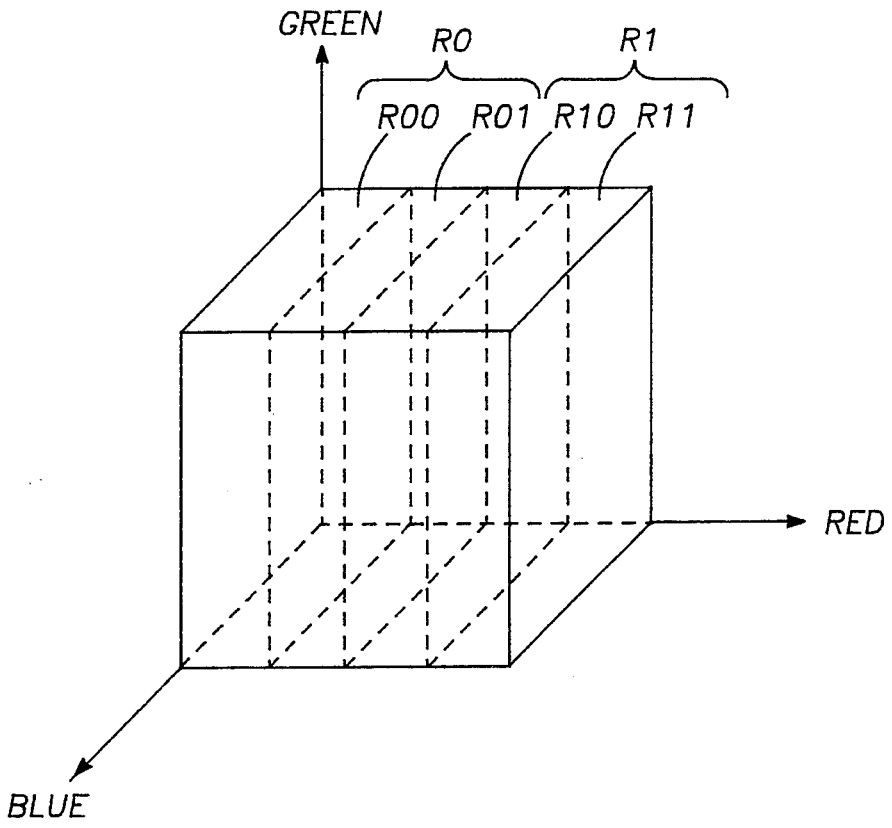
FIG. 11 illustrates how color bit r1 affects division of the color universe cell.

Referring to FIG. 11, there is shown that the two possible values ("0" or "1") of r1 bit divides part R0 and part R1 into four parts R00, R01, R10 and R11. If a color vector has "0" value of r0 bit and "0" value of r1 bit, it will fall within part R00; and if a color vector has "0" value of r0 bit and "1" value of r1 bit, it will fall within part R01; if a color vector has "1" value of r0 bit and "0" value of r1 bit, it will fall within part R10; and if a color vector has "1" value of r0 bit and "1" value of r1 bit, it will fall within part R11. That is:

| r0g0b0 | r1g1b1 | r2g2b2 | ... | r7g7b7 | |
|---|---|---|---|---|---|
| 0 x x | 0 x x | x x x | ... | x x x | (part R00 of FIG. 11) |
| 1 x x | 0 x x | x x x | ... | x x x | (part R10 of FIG. 11) |

-continued

| r0g0b0 | r1g1b1 | r2g2b2 | ... | r7g7b7 | |
|---|---|---|---|---|---|
| 0 x x | 1 x x | x x x | ... | x x x | (part R01 of FIG. 11) |
| 1 x x | 1 x x | x x x | ... | x x x | (part R11 of FIG. 11) |

Figure 12:
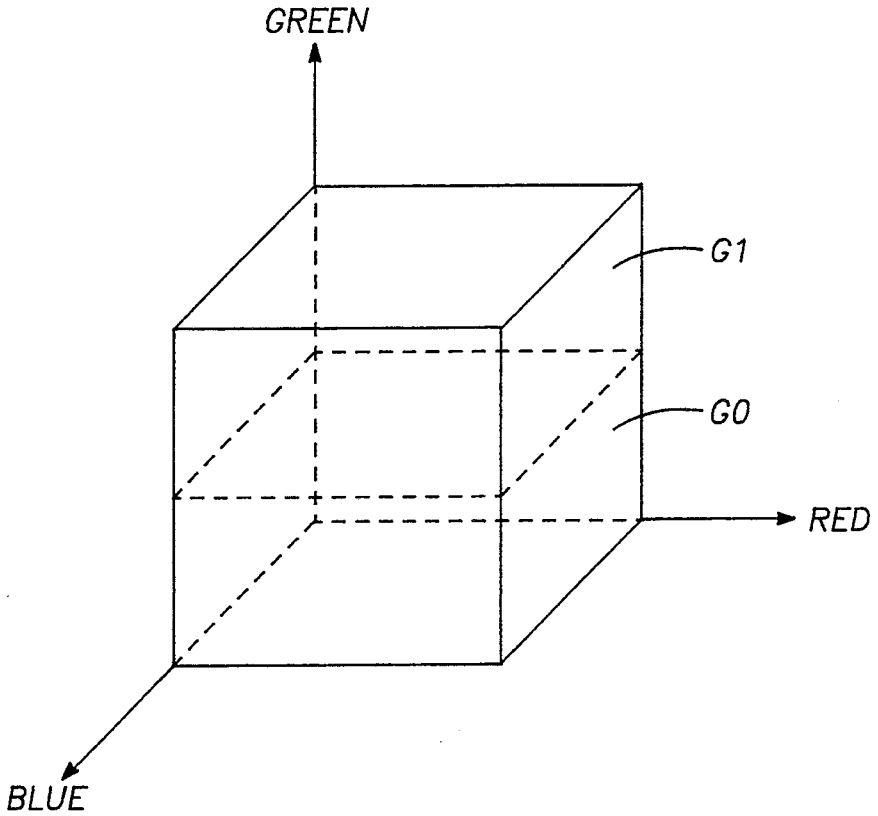
FIG. 12 illustrates how color bit g0 affects division of the color universe cell.

By the same principle, two possible values of g0 bit divides the color universe cell as follows:

| r0g0b0 | r1g1b1 | r2g2b2 | ... | r7g7b7 | |
|---|---|---|---|---|---|
| x 1 x | x x x | x x x | ... | x x x | (part $G_1$ of FIG. 12) |
| x 0 x | x x x | x x x | ... | x x x | (part $G_0$ of F1G. 12) |

Figure 13:
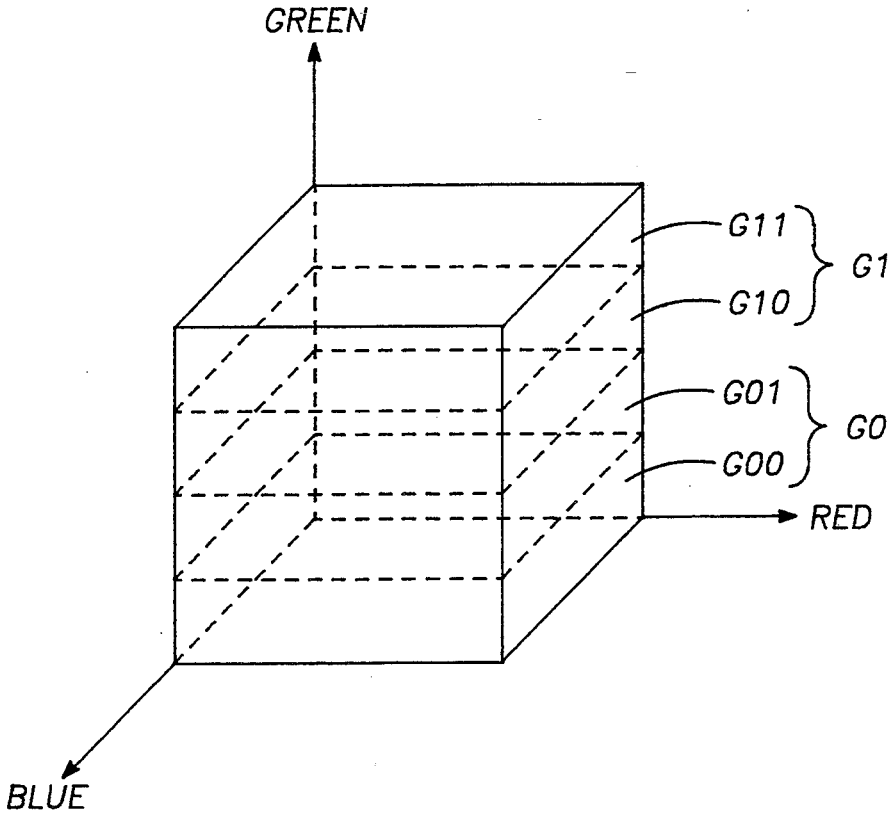
FIG. 13 illustrates how color bit g1 affects division of the color universe cell.

Two possible values of g1 bit divide the color universe cell as follows:

| r0g0b0 | r1g1b1 | r2g2b2 | ... | r7g7b7 | |
|---|---|---|---|---|---|
| x 0 x | x 0 x | x x x | ... | x x x | (part G00 of FIG. 13) |
| x 1 x | x 0 x | x x x | ... | x x x | (part G10 of FIG. 13) |
| x 0 x | x 1 x | x x x | ... | x x x | (part G01 of FIG. 13) |
| x 1 x | x 1 x | x x x | ... | x x x | (part G11 of FIG. 13) |

Figure 14:
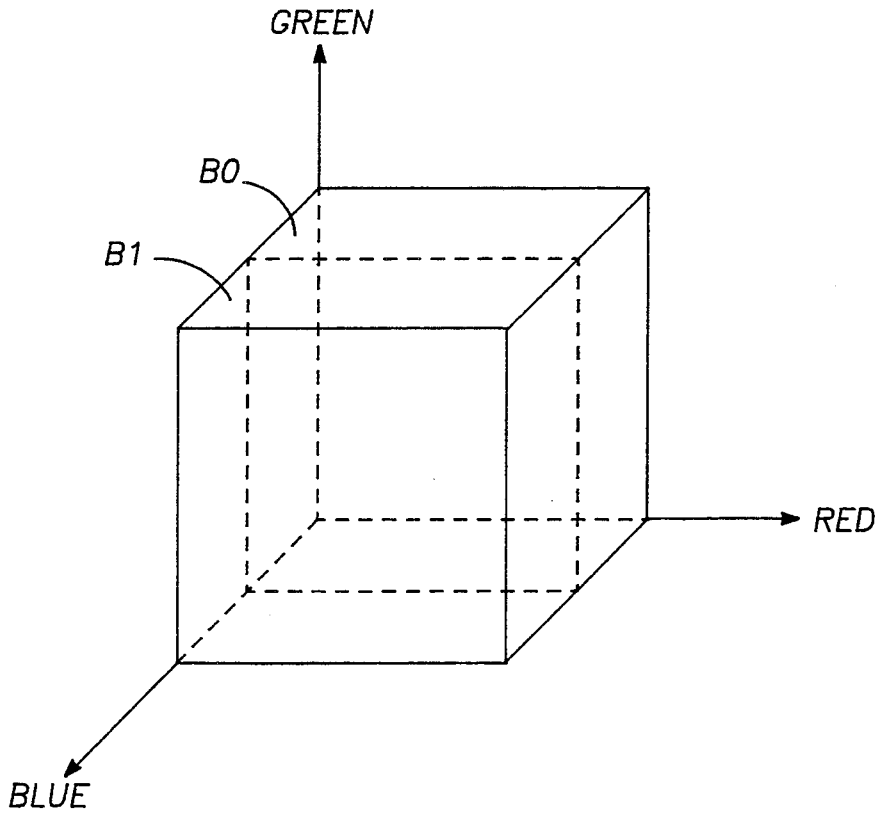
FIG. 14 illustrates how color bit b0 affects division of the color universe cell.

Two possible values of b0 bit divide the color universe cell as follows:

| r0g0b0 | r1g1b1 | r2g2b2 | ... | r7g7b7 | |
|---|---|---|---|---|---|
| x x 1 | x x x | x x x | ... | x x x | (part B1 of FIG. 14) |
| x x 0 | x x x | x x x | ... | x x x | (part B0 of FIG. 14) |

Figure 15:
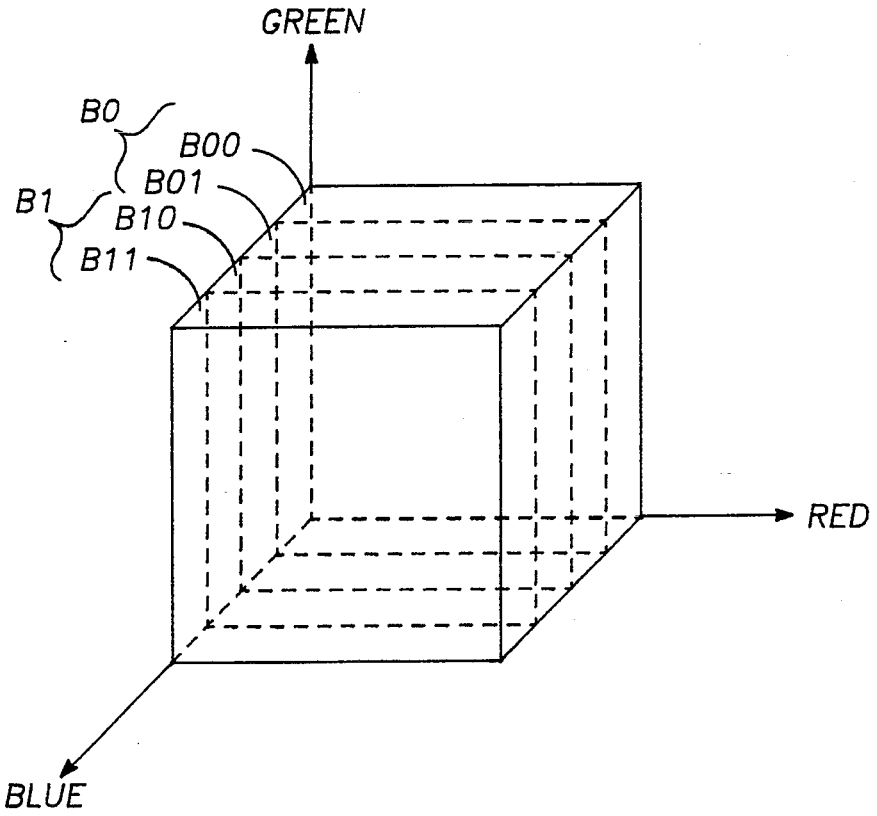
FIG. 15 illustrates how color bit b1 affects division of the color universe cell.

Two possible values of b1 bit divide the color universe cell as follows:

| r0g0b0 | r1g1b1 | r2g2b2 | ... | r7g7b7 | |
|---|---|---|---|---|---|
| x x 1 | x x 0 | x x x | ... | x x x | (part b10 of FIG. 15) |
| x x 1 | x x 1 | x x x | ... | x x x | (part b11 of FIG. 15) |
| x x 0 | x x 0 | x x x | ... | x x x | (part b00 of FIG. 15) |
| x x 0 | x x 1 | x x x | ... | x x x | (part b01 of FIG. 15) |

Figure 10:
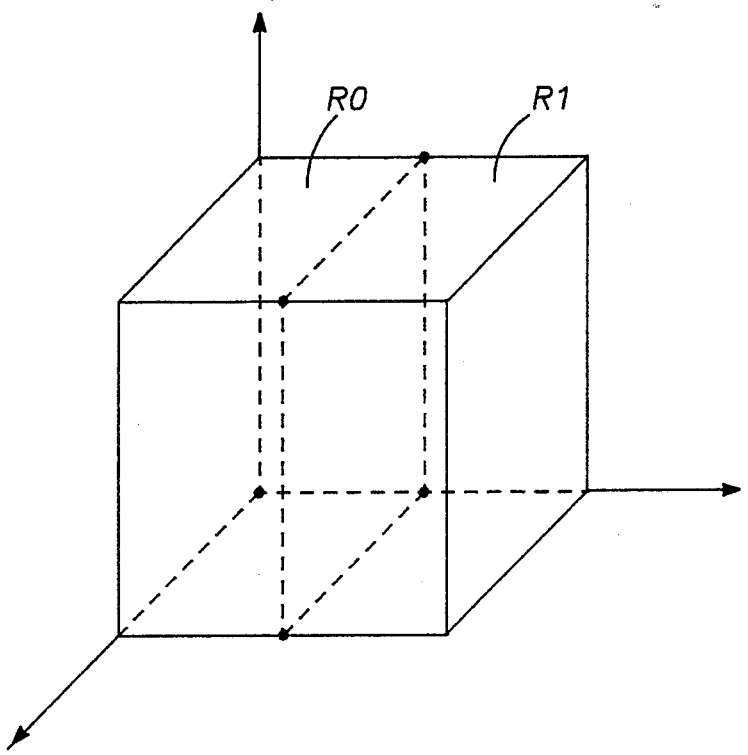
FIG. 10 illustrates how color bit r0 affects division of the color universe cell.

From the above specific illustrations, it should be noticed that the preceding color bit has a prior effect on the trailing color bit, meaning that how the trailing color bit divides the color universe cell depends on the specific value of its all preceding bits. First, take color bits r0 and r1 as an example. As illustrated in FIG. 10, the two possible values of r0 bit divide the color universe cell into part R0 and part R1. As illustrated in FIG. 11, the two possible values of r1 bit divide the color universe cell in FIG. 10 into four parts, namely, divide Part R0 (in FIG. 10) into part R00 and part R01 if r0 bit is "0"; and divide part R1 (in FIG. 10) into part R10 and part R11 if r0 bit is "1".

Figure 16A:
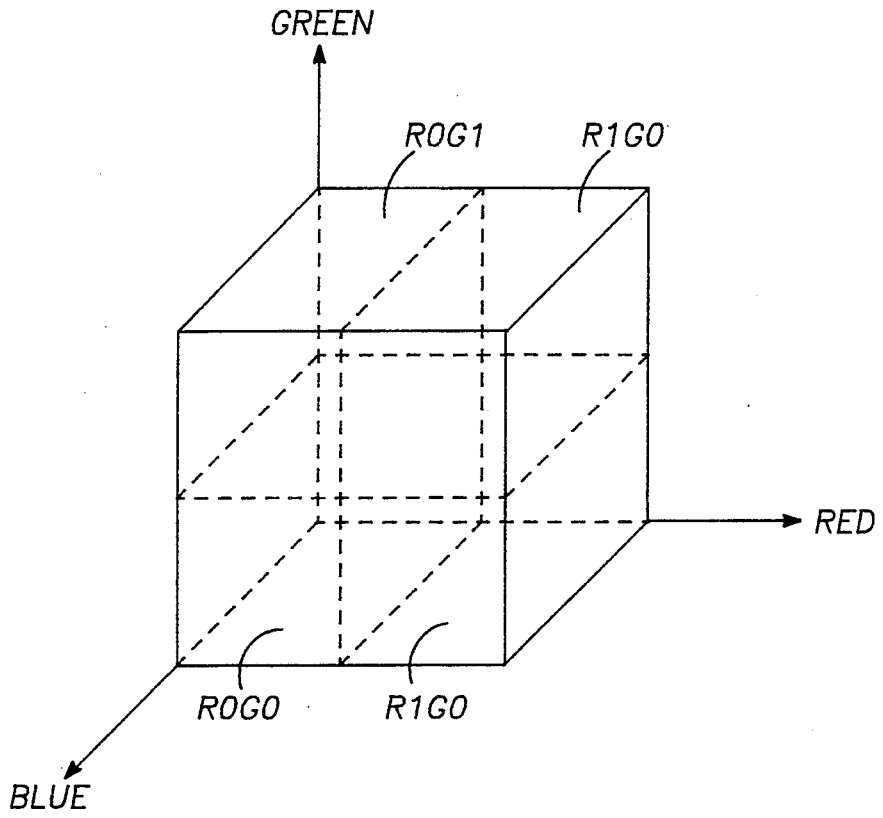
FIG. 16A illustrates four combinations of color bits r0 and g0 divide the color universe cell into four equal cells.
Figure 16B:
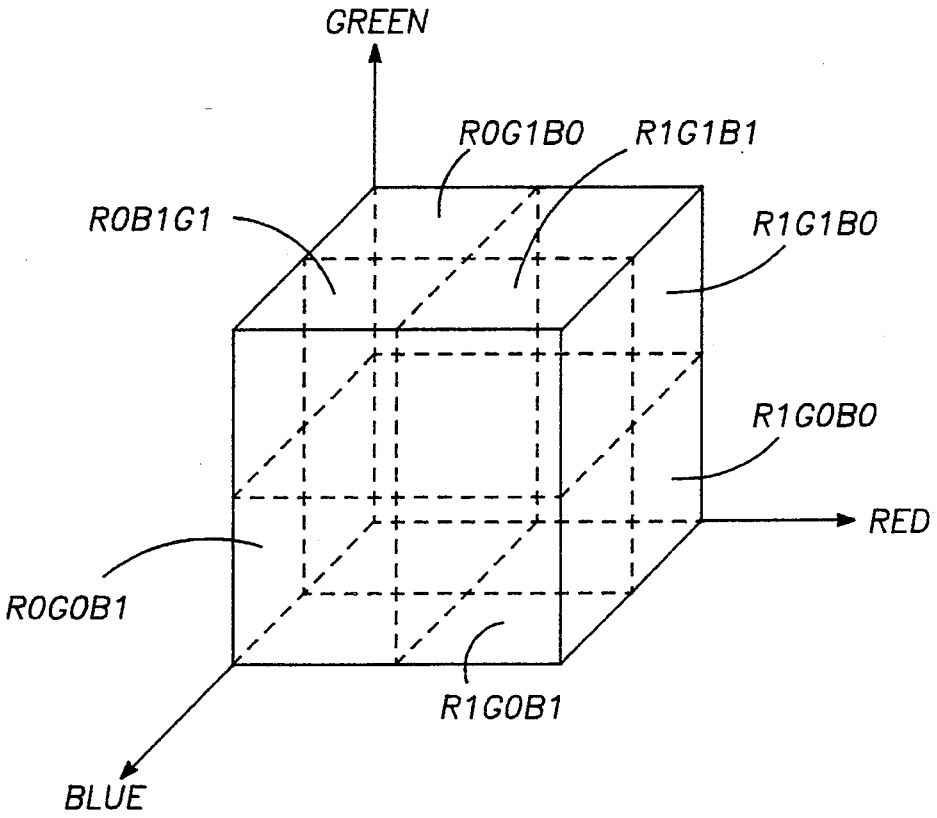
FIGS. 16 and 17 illustrate that eight combinations of color bits r0, g0 and b0 divide the color universe cell into 8 equal cells.
Figure 17:
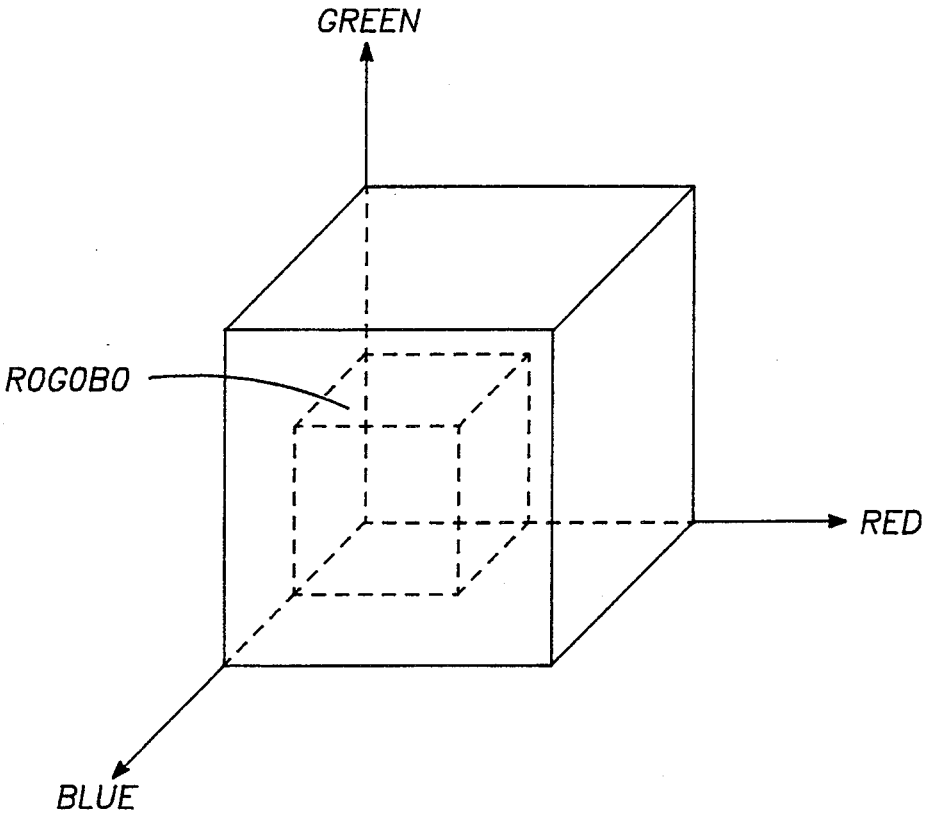

Take color bits r0, g0 and b0 as another example. As illustrated in FIG. 16A, the two possible values of g0 bit divides the color universe cell in FIG. 10 into four parts, namely, divide R0 (in FIG. 10) into part R0G0 and part R0G1 if r0 bit is "0"; and divide part R1 (in FIG. 10) into part R1G0 and part R1G1 if r0 bit is "1". As illustrated in FIG. 16, the two possible values of b0 bit will divide the color universe cell in FIG. 16A into eight parts, namely, divide part R0G0 (in FIG. 16A) into part R0G0B0 and part R0G0B1 if the two possible values of r0, g0 bits are "00"; divide part R0G1 into part R0G1B0 and part R0G1B1 if r0, g0 bits are "01"; cut part R1G0 (in FIG. 16A) into part R1G0B0 and part R1G0B1 if the two possible values of r0, g0 bits are "10"; and cut part R1G1 into part R1G1B0 and part R1G1B1 if r0, g0 bits r0, g0 are "11".

Reference is now made back to the illustrative drawings of FIG. 7. Before the color universe cell is divided, weight generator 78 and address generator 80 first generate color distribution of the color image, and store the distribution in HISTTABLE 88. The color distribution for the color image in the HISTTABLE provides weight information for dividing the color universe cell. At initial state, each memory cell in HISTTABLE is set to zero (0). Address generator 80 sequentially accesses memory cells in storage device 82 for all pixels, and converts the color bits for each pixel in an order as r0g0b0r1g1b1r2g2b2r3g3b3. A specific number generated by address generator 80 represents an address in the HISTTABLE. Weight generator 78 adds one (1) in the memory cell according to the address provided by address generator 80. Thus, a number in an address of the HISTTABLE represents how many pixels are mapped to the address of the HISTTABLE. The color distribution is generated after the address generator goes through all pixels. Thus, the summation of weights in the HISTTABLE equals the total number of pixels in the color image. It should be noticed that, because the color bits r4r5r6r7, g4g5g6g7 and b4b5b6b7 are not considered, two pixels having the same color combination in color bits r0r1r2r3, g0g1g2g3 and b0b1b2b3 will be mapped into a same address in the HISTTABLE even if their color combinations in color bits r4r5r6r7, g4g5g6g7 and b4b5b6b7 are different. After the color distribution of the color image is generated in the HISTTABLE, the color universe cell is ready to be divided.

Referring back to FIG. 2, there is shown the un-divided color universe cell. The head of a cell can be defined as the point closest to original of the color universe cell, and the tail of a cell as the point farthest to original of the color universe cell. Thus, point "a" corresponding to number "0000" (in octal) is the head for the un-divided color universe cell; and point "b" corresponding to number "7777" (in octal) is the tail for the un-divided color universe cell. The range from the head to the tail (0000–7777 in octal) covers all addresses of the HISTTABLE.

Referring to FIG. 18, there is shown the changes of the FABLE the the during dividing process. In initial state, corresponding to the un-divided color universe cell, the FABLE contains one element with one head 0000 (octal) (point "a" in FIG. 2) and one tail 7777 (octal) (point "b" in FIG. 2). The weight $W_u$ equals the number of total pixels in a color image.

Referring back to FIG. 3, there is shown that the color universe cell is divided into two equal size cells, namely cell A and cell B, along the Red axis. It is noticed that the head (point "a") for the color universe cell is also the head for cell A; and the tail (point "b") for the color universe cell is also the tail for cell B. The new tail (point "c") for cell A can be obtained by flipping r0 bit from "1" to "0" in the previous tail (point "b"); and the new head for the cell B can be obtained by flipping r0 bit from "0" to "1" in the previous head (point "a"). Step 1 in FIG. 18 illustrates that the head for cell A and the tail for cell B are obtained by copying the previous head and tail; and tail for cell A and head for cell B are obtained by flipping the r0 bit from the previous head and tail. Head A (point "a") and tail A (point "c") cover the address range 0000–3777 (in octal) of HISTTABLE, thus the weight $W_A$ for cell A can be obtained by adding all weights within address range 0000–3777 (in octal) in the HISTTABLE; and head B (point "d") and tail B (point "b") cover the address range 4000–7777 (in octal) of HISTTABLE, thus the weight $W_B$ for cell B can be obtained by adding all weights within address range 4000–7777 (in octal) in the HISTTABLE. It is noticed that, from above explanation, that a head and a corresponding tail always define a correspondence relationship between an address range of HISTTABLE and the boundary of a divided cell. Thus, the FABLE can be deemed as an index to the HISTTABLE.

Referring to FIG. 4, there is shown that cell B is chosen to be divided into two equal size cells, namely cell C and cell D, along the Green axis. Step 2 of FIG. 18 illustrates that the head for cell D and the tail for cell C are obtained by copying the previous head and tail for cell B; and head for cell C and tail for cell D are obtained by flipping the g0 bit from the previous tail and head for cell B. Head D (point "d") and tail D (point "f") cover the address range 4000–5777 (in octal) of HISTTABLE, thus the weight $W_D$ for cell D can be obtained by adding all weights within address range 4000–5777 (in octal) in the HISTTABLE; and head C (point "e") and tail C (point "b") cover the address range 6000–7777 (in octal) of HISTTABLE, thus the weight $W_C$ for cell C can be obtained by adding all weights within address range 6000–7777 (in octal) in the HISTTABLE.

Referring to FIG. 5, there is shown that cell D is chosen to be divided into two equal size cells, namely cell E and cell F, along Blue axis. Step 3 of FIG. 18 illustrates that the head (point "d") for cell F and the tail (point "f") for cell E are obtained by copying the previous head and tail for cell D; and head (point "h") for cell E and tail (point "g") for cell F are obtained by flipping the b0 bit from the previous tail and head for cell D. Weight $W_E$ for cell E and Weight $W_F$ for cell F are obtained by using the same method mentioned in steps 1 and 2. Referring to the illustrative drawings of FIG. 6, there is shown that cell A is chosen to be divided into two equal size cells, namely cell G and cell H, along Green axis. Step 4 of FIG. 18 illustrates that the head (point "a") for cell H and the tail (point "c") for cell G are obtained by copying the previous head and tail for cell A; and head (point "j") for cell G and tail (point "i") for cell H are obtained by flipping the g0 bit from the previous tail and head for cell A.

The general method of determining which bit to be flipped in dividing a cell is by examining the bit patterns in the head and tail of the cell. The first different bit (from left to right) between the head and the tail is the bit to be flipped. For example, for cell D, the head and tail are 10–0000000000 and 10–1000000000 respectively; thus, bit b0 needs to be flipped in order to divide cell D.

This process will repeat until 256 cells are formed in the FABLE. Since the last four color bits of each pixel are omitted during cell dividing precess, the unit cell has a size of 16×16×16. If the cell which has the heaviest weight is of the unit size (16×16×16), the next heaviest cell which is larger than size (16×16×16) will be chosen to be divided. The difference between a head and the corresponding tail can be used to decide whether the associated cell is larger than or equal to the unit size. The special color bit arrangement in HISTTABLE and FABLE makes the division of the color universe cell simple and fast because to evenly divide a part in the color universe cell one only needs to flip bit.

The color bit flipping can be accomplished by cell divider 76 in FIG. 7.

After the 256 cells have been formed, the color combination represented by the centroid of a specific cell will be assigned to all the pixels within the specific cell. The centroid of a square or rectangular box is located in the center of its diagonal, representing by formula (head+tail)/2. However, due to the special color bit arrangement, the centroid can be obtained by selecting the first different bit (starting from left) of the head and tail of a cell and flipping the first different bit in the head of the cell from "0" to "1". For example, the centroid of cell C as shown in FIG. 18 can be obtained by flipping b0 in the head of cell C from "0" to "1", and the centroid of cell G as shown in FIG. 18 can be obtained by flipping bO in the head of cell G from "0" to "1".

Referring to FIG. 7, color generator 99 is responsible to produce the 256 centroids as 256 selected colors based on the information in the FABLE. Each address in FABLE 84 has a correspondent address in color table 96. Color generator 99 stores the 256 selected colors into corresponding addresses in color table 96.

While the 256 colors are being selected, updator 86 updates HISTTABLE 88 to generate index to the color table 96 for the color image. When color generator 99 generates a color and stores it into a memory cell associated with an address in the color table 96, updator 86 fills the color table address into memory cells in the HISTTABLE with a range from the associated head and tail. In FIG. 18, cell G as an example, assume cell G is one of the 256 cells and assume the selected color for cell G is stored in a memory cell of address 7 in color table 96, addresses covered by the head and the tail from 010000000000 (2000 in octal) to 011111111111 (3777 in octal) of the HISTTABLE will be filed with 7, meaning all color vectors which are mapped within 2000–3777 (octal) have index 7 to the color table 96. After the updating process, HISTTABLE 88 contains an index to color table 96 for the color image.

After the index to the color table for the color image is formed, address generator 80 and index generator 90 generate an index to color table 96 for all the pixels according to the index in HISTTABLE 88. The index to color table 88 for all pixels is stored in index memory 98. Like the process of generating color distribution for the color image, address generator 80 accesses memory cells in storage device 82 for all pixels again. The color bits for each pixel are converted into an address of the HISTTABLE in a format as r0g0b0r1g1b1r2g2b2r3g3b. Since each pixel associated with an address in storage device 82 has a corresponding address in index memory 98, index generator 90 can select a color address in HISTTABLE according to the address provided by address generator 80 and feed this color address into the corresponding memory cell of index memory 98. For example, if a pixel having address of 0047 (in octal) in storage device 82 has color combination 3000 (in octal), the corresponding address 0047 (in octal) in index memory 98 will be filled with 7 because the index in the memory cell with address 3000 of the HISTTABLE is 7. After address generator 80 and index generator 90 access all pixels in storage device 82, the index to the color table for all pixels are formed in index memory 98. Finally, the color image can be displayed on displayer 92 according to the color information in color table 96 and pixel position information in index memory 98. If necessary, the selected 256 colors in the color table and index to the color table for all pixels can be stored into storage device 82 so that the processed color image information can be displayed by recalling the processed color information from the storage device in the future.

Figure 19:
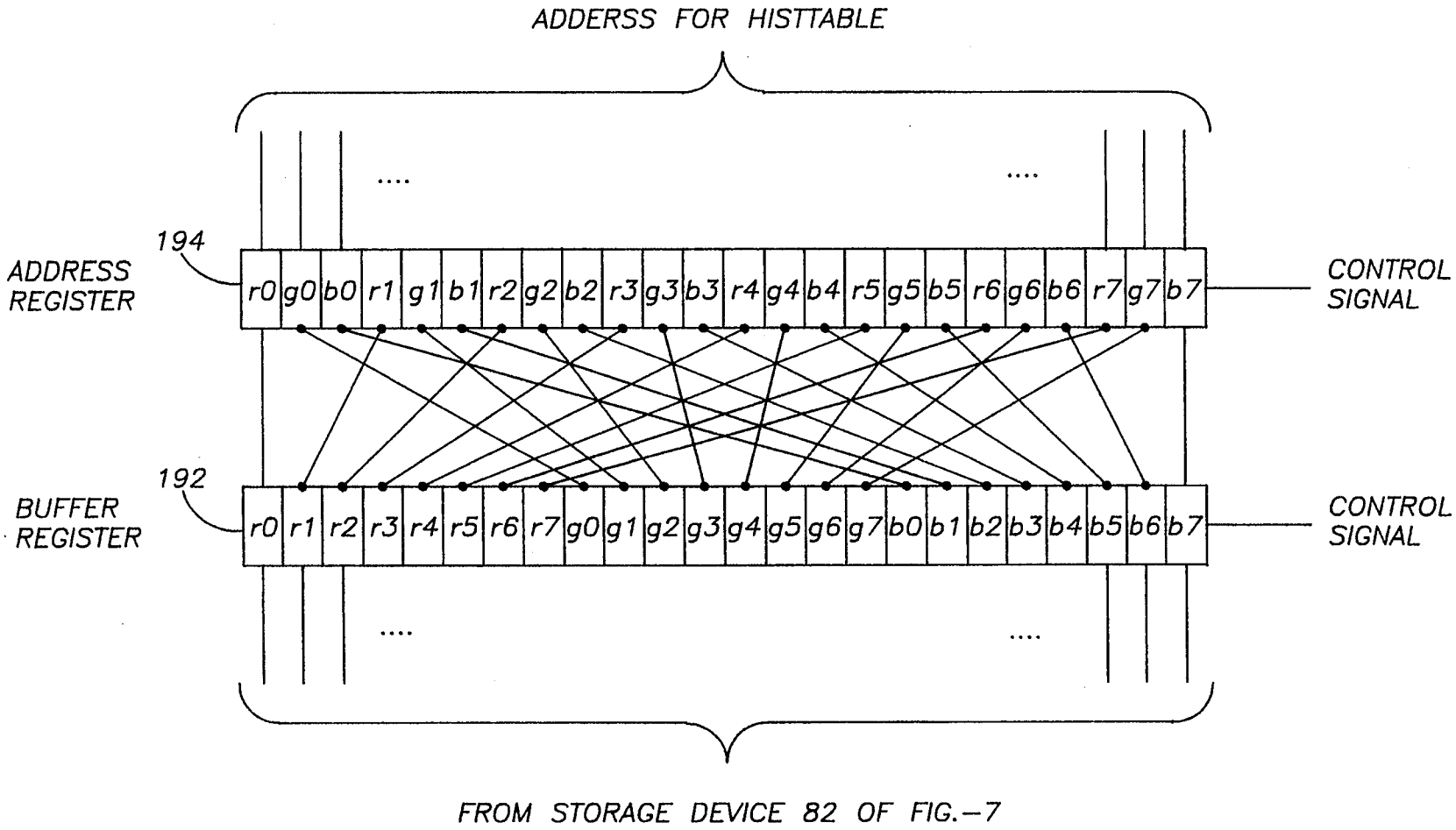
FIG. 19 illustrates one possible embodiment of the address generator shown in FIG. 7.

In the color image display system 70 as illustrated in FIG. 7, the function blocks of cell divider 76, weight generator 78, address generator 80, updator 86, index generator 90 and color generator 99 can be implemented by pure hardware or pure software, or combinations of hardware and software. The detail design of the hardware in the function blocks can be implemented in various ways according to the disclosure of this invention. It mainly consists of registers, memory, transmitting gates, state control logic, arithmetic logic unit (ALU), etc. Referring to the illustrative drawings of FIG. 19, there is shown one possible hardware implementation of address generator 80. Buffer register 192 receives color bits of red, green and blue in their original order in the storage device, and connects the red color bits, green color bits and blue color bits alternatively to address register 194.

Figure 20:
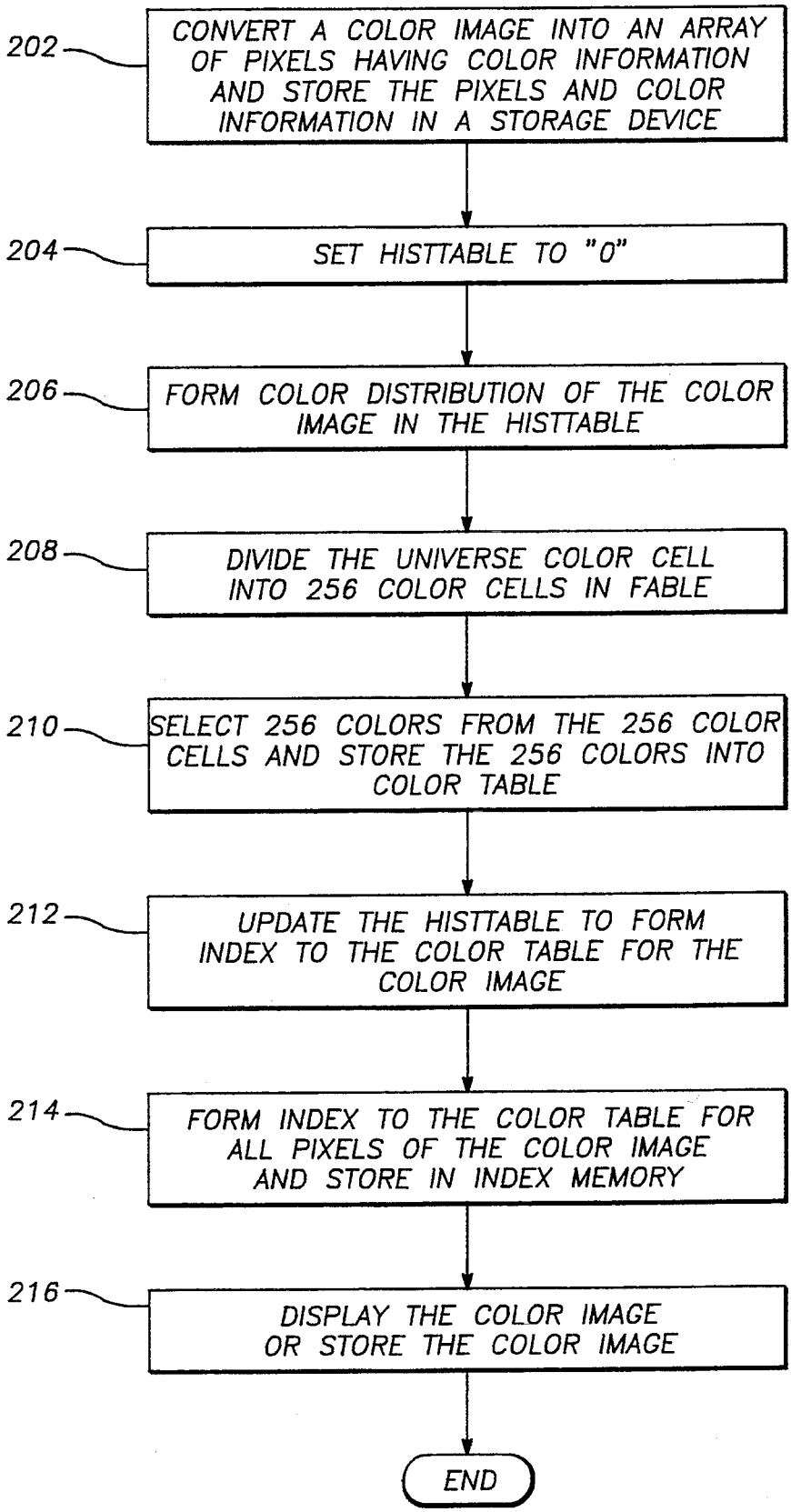
FIGS. 20–23 illustrate flow charts of the algorithm of the present invention.
Figure 21:
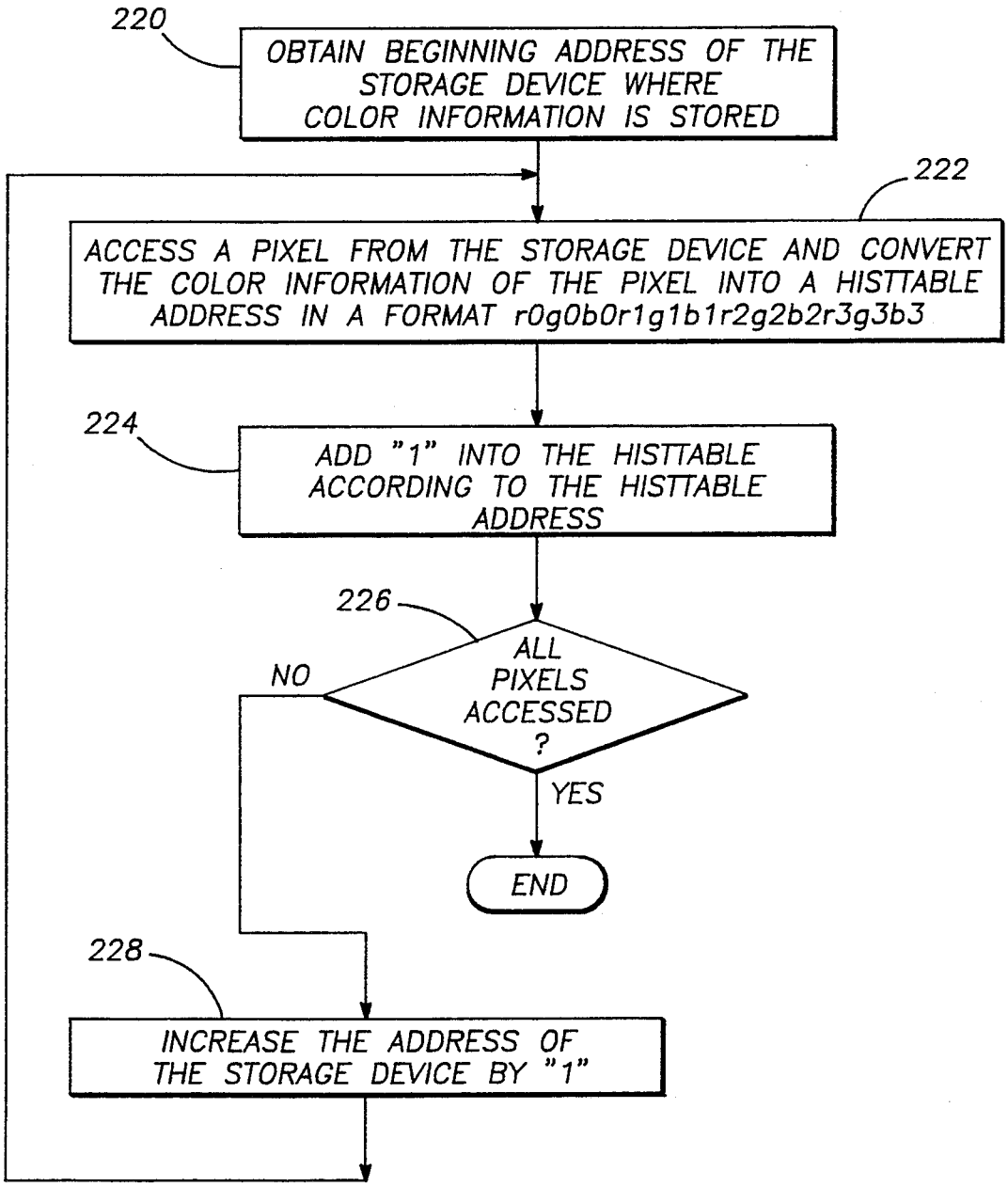
Figure 22:
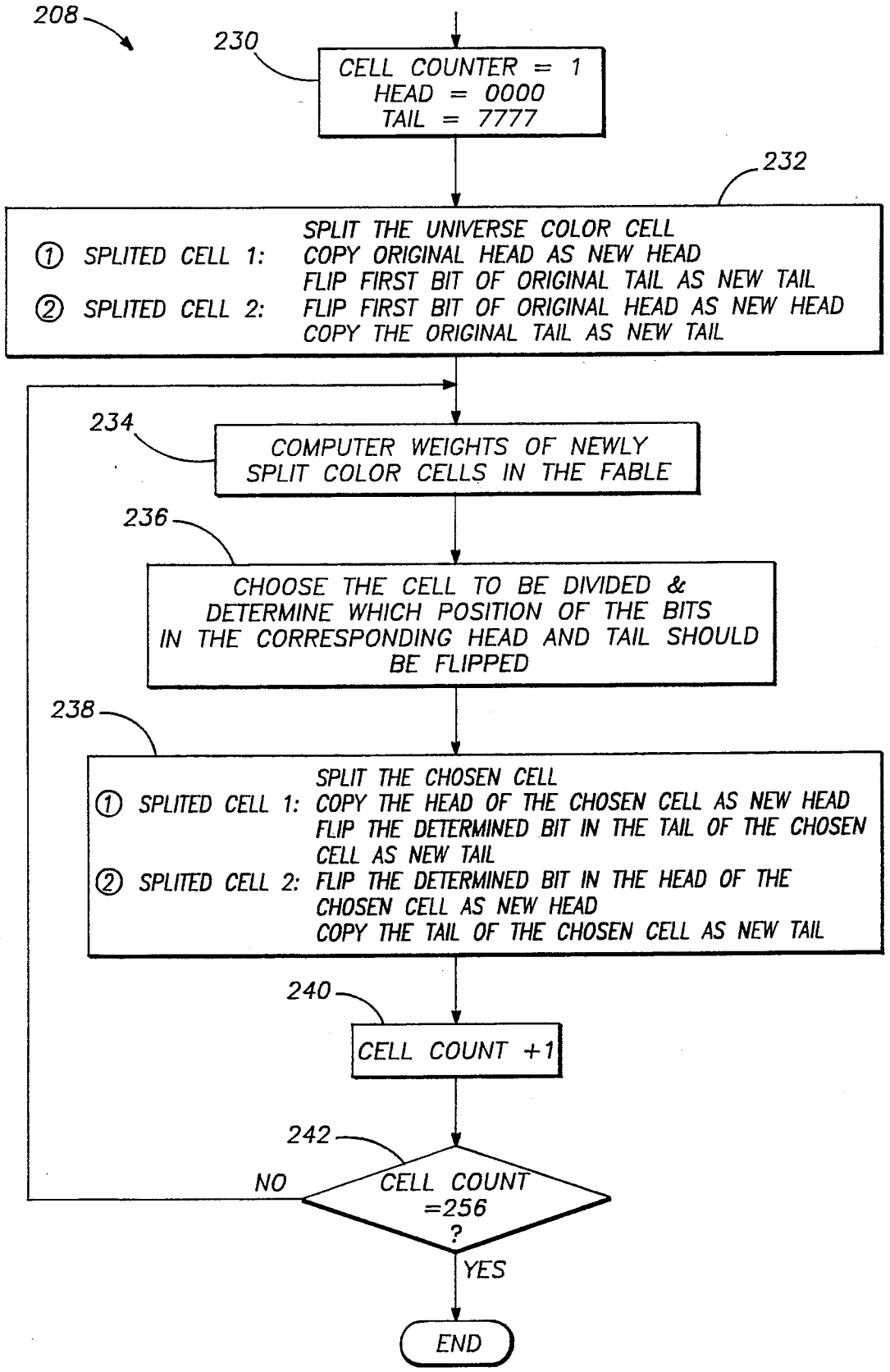
Figure 23:
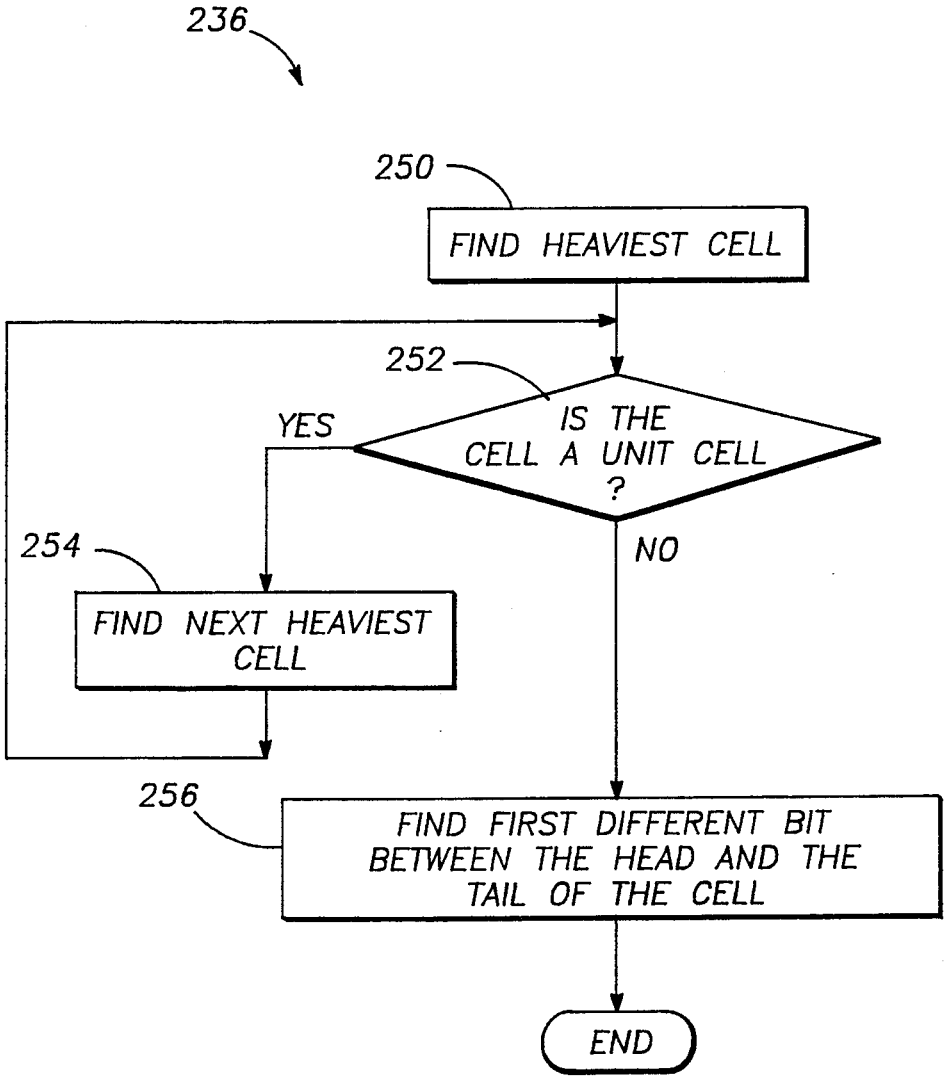

Referring to FIG. 20, there is shown the flow chart of the color quantization process. Referring to FIG. 21, there is shown the details of step 206 of FIG. 20. Referring to FIG. 22, there is shown the details of step 208 of FIG. 20. Referring to FIG. 23, there is shown the details of step 236 of FIG. 22. All steps in the flow charts have been explained above.

The Color Quantization Algorithm in accordance with the present invention has advantages as follows:

1. This algorithm provides a simple, fast and accurate method to select the best 256 colors. The simple nature of this algorithm make it feasible to be implemented in hardware to further increase the speed of color quantization. The HISTTABLE structure is a memory-efficient representation of the color distribution of a color image. A 8.5×11 at 300 dpi density color image requires 25 mega bytes of memory. Assuming each element in the HISTTABLE requires 24 bits, the size of the HISTTABLE is only 12 k bytes. The special bit arrangement of the HISTTABLE makes it very simple to divide the color cells. By changing only one bit in the index of the HISTTABLE, the color cell can be evenly divided into two. The head and tail elements in FABLE give the exact orientation of any color cell inside the color universe. The range from head to tail in the HISTTABLE gives the distribution of the pixels inside the color cell. The weight provides the information to choose the heaviest cell.
2. The algorithm of the present invention is expandable. If more detail representation of the color is desired, the bit definition of the HISTTABLE can be easily expanded from 12 bits to 15 bits:

r0 g0 b0 r1 g1 b1 r2 g2 b2 r3 g3 b3 r4 g4 b4 (15 bits)

The memory size for a 15 bit HISTTABLE is 98K bytes. If reducing memory size is desired, the bit definition of the HISTTABLE can be easily reduced from 12 bits to 9 bits:

r0 g0 b0 r1 g1 b1 r2 g2 b2 (9 bits)

The memory size for a 9 bit HISTTABLE is 1.5K bytes.

The number of colors to be selected can be easily modified. By dividing the color cell 512 times, 512 best colors are selected. As a result, the color quantization algorithm can be applied on different kinds of color frame buffers.

3. The color cells are divided according to their weights, and all colors of the pixels with a color cell are represented by the centroid of the color cell. This arrangement is a good color representation of original color image, thus preserving the originality of the color image.

This algorithm can potentially be used in the color scanners, personal computers, digital copiers, digital video camcorder, fax machine, etc. For example, a Ricoh Personal Computer can use the quantization algorithm to display color image on the screen. As for future color copiers, there may be a need to display color images on the front panel. To reduce cost, the front panel may only be a be to display 256 colors instead of the 16 million colors. On the other hand, most of the current video camcorders have only B/W displays because a small full-color display is too expensive. A 256 color display may be an alternative.

The principle of this algorithm can be applied in other areas. As long as the three components are orthogonal to each other, this algorithm can be used to divide the space into a number of cells based on the histogram distribution.

While a particular embodiment of the invention has been described in detail, it will be understood that the invention may be implemented through alternative embodiments. Thus, the scope of the invention is not intended to be limited to the embodiment described above, but is to be defined by the appended claims.

What is claimed:

1. In a digital color image display system wherein a color image is stored as an array of pixels, each pixel having an associated color represented by three, basic colors, each of said basic colors having n+1 bits where n is greater than zero, thus all color combinations of said three n+1 bits of the three basic colors form a color universe which includes all possible color combinations of the pixels, said digital color image display system comprising:

(a) first memos- means for storing color distribution of the pixels in said color universe, said first memory means having a sequence of addresses whose whole range encompasses said color universe; and (b) first address means for mapping each pixel into one of said addresses of said first memory means according to the said three n+1 bits of the three basic colors associated to said each pixel:

wherein said three n+1 bits of said three basic colors have a format r0 r1 r2 r3 . . . rn g0 g1 g2 g3 . . . gn b0 b1 b2 b3 . . . bn wherein said sequence of addresses of said first memory means has an address format r0 g0 b0 r1 g1 b1 r2 g2 b2 . . . rn gn bn, and wherein said first address means forms said address format for said first memory means by converting said three n+1 bits of said three basic colors into said address format r0 g0 b0 r1 g1 b1 r2 g2 b2 . . . rn gn bn.

2. The digital color image display system of claim 1, further comprising:

first counting means for generating said color distribution in said color universe by adding a number in an address converted by said first address means.

3. The digital color image display system of claim 1, further comprising:

(c) dividing means for splitting said color universe into a plurality of split color cells according to said color distribution, each of said split color cells corresponding to a section of said sequence of addresses of said first memory means; and (d) second memory, means for forming an index to said first memory means by recording a plurality of address boundaries in said sequence of addresses in said first memory, means said plurality of address boundaries corresponding to said plurality of split color cells respectively.

4. The digital color image display system of claim 3, wherein said second memory means further comprises:

means for storing heads for said plurality of split color cells, each of said heads recording a beginning address in said first memory means; and means for storing tails for said plurality of split color cells, each of said tails recording an ending address in said first memory means;

wherein a head and a corresponding tail indicate a section of said sequence of addresses in said first memory means, said section corresponding to a respective one of said plurality of split color cells.

5. The digital color image display system of claim 4, further comprising:

second counting means for generating weights for said plurality of split color cells according to said address boundaries indicated by said heads and tails stored in said second memory means.

6. The digital color image system of claim 4, wherein said heads and tails have an address format r0 g0 b0 r1 g1 b1 r2 g2 b2 . . . rn gn bn, and wherein said dividing means splits said color universe by flipping one bit in a chosen one of said heads and flipping a corresponding bit in a chosen one of said tails.

7. The digital color image system of claim 3, further comprising:

color means for generating a plurality of colors for said pixels based on said split color cells.

8. The digital color image system of claim 7, wherein said color means generates said plurality of colors based on arithmetic means of said heads and tails.

9. The digital color image display system of claim 8, wherein said arithmetic mean is obtained by flipping one bit in said heads.

10. The digital color image display system of claim 7, further comprising a third memory means for storing said plurality of colors, said each of said plurality of colors is stored in a memory cell associated with an address of said third memory means.

11. The digital color image display system of claim 10, further comprising:

a fourth memory means for storing addresses of said third memory means where said generated colors are stored, said fourth memory means having a sequence of addresses that encompasses said color universe, wherein a section of said sequence of addresses indicated by a corresponding head and tail in said second memory means is filled with a third memory address for storing one generated color based on said corresponding head and tail.

12. The digital color image display system of claim 11, wherein said sequence of addresses of said fourth memory means has an address format r0 g0 b0 r1 g1 b1 r2 g2 b2 . . . rn gn bn, and wherein said first address means forms said address format for said fourth memory by means by converting said three n+1 bits of the three basic colors into said address format r0 g0 b0 r1 g1 b1 r2 g2 b2 . . . rn gn bn.

13. The digital color image system of claim 12, further comprising:

a storage device for storing said pixels;

fifth memory means for storing an index to said third memory means for said pixels, wherein each of said pixels has position information indicating its position in said fifth memory means, wherein each of said pixels stored in said storage device has a corresponding address in said fifth memory means;

a second address means for mapping each pixel into one of said addresses of said fourth memory means according to the three n+1 bits of the three basic colors associated to said each pixel; and loading means, in response to an address generated by said second address means for loading a color address in said fourth memory means to said fifth memory means.

14. The digital color image display system of claim 13, wherein said second address means forms an address format by converting said three n+1 bits of said three basic colors into said address format r0 g0 b0 r1 g1 b1 r2 g2 b2 . . . rn gn bn.

15. The digital color image display system of claim 1, further comprising:

color means for generating a plurality of colors for said pixels based on said color distribution.

16. The digital color image display system of claim 1, wherein said color distribution representing a histogram distribution of said pixels m said color universe.

17. For use with a digital color image display system wherein a color image is stored as an array of pixels, each pixel having an associated color represented by three basic colors, each of said basic colors having n+1 bits where in is greater than zero, thus all color combinations of said three n+1 bits of the three basic colors form a color universe which includes all possible color combinations of the pixels, a method for processing color quantization comprising the steps of:

(a) storing color distribution of the pixels in said color universe in a first memory means having a sequence of addresses, whose whole range encompasses said color universe; and (b) mapping each pixel into one of said addresses of said first memory means according to said three n+1 bits of the three basic colors associated to said each pixel;

wherein said three n+1 bits of said three basic colors have a format r0 r1 r2 r3 . . . rn b0 b1 b2 b3 . . . bn wherein said sequence of addresses of said first memory means has an address format r0 g0 b0 r1 g1 b1 r2 g2 b2 . . . rn gn bn, and wherein said step (b) forms said address format for said first memory means by converting said three n+1 bits of said three basic colors into said address format r0 g0 b0 r1 g1 b1 r2 g2 b2 . . . rn gn bn.

18. The method of claim 17 further comprising the steps of:

(c) splitting said color universe into a plurality of split color cells according to said color distribution, each of said split color cells corresponding to a section of said sequence of addresses of said first memory means; and (d) forming an index to said first memory means by recording a plurality of address boundaries in said sequence of addresses in said first memory means, said plurality of said address boundaries corresponding to said plurality of split color cells respectively.

19. The method of claim 18, wherein said step (d) further comprises the steps of:

storing heads for said plurality of split color cells, each of said heads recording a beginning address in said first memory means; and storing tails for said plurality of split color cells, each of said tails recording an ending address in said first memory means;

wherein a head and a corresponding tail indicate a section of said sequence of addresses in said first memory means, said section corresponding to a respective one of said plurality of split color cells.

20. The method of claim 19, wherein said heads and tails have a format r0 g0 b0 r1 g1 b1 r2 g2 b2 . . . rn gn bn, and wherein said step (c) splits said color universe by flipping one bit in a chosen one of said heads and flipping corresponding bit in a chosen one of said tails.

21. The method of claim 17, wherein said color distribution representing a histogram distribution of said pixels in said color universe.

* * * * *